US008376299B2

(12) United States Patent
Burkman

(10) Patent No.: US 8,376,299 B2
(45) Date of Patent: Feb. 19, 2013

(54) APPARATUS AND METHOD FOR DISPLAYING PICTURES AND FLAT ART OBJECTS

(76) Inventor: Don Charles Burkman, Osceola, WI (US)

( * ) Notice: Subject to any disclaimer, the term of this patent is extended or adjusted under 35 U.S.C. 154(b) by 0 days.

(21) Appl. No.: 12/945,385

(22) Filed: Nov. 12, 2010

(65) Prior Publication Data

US 2011/0079693 A1 Apr. 7, 2011

Related U.S. Application Data

(63) Continuation of application No. 29/281,161, filed on Jun. 15, 2007, now Pat. No. Des. 629,215.

(51) Int. Cl.
*A47G 29/02* (2006.01)

(52) U.S. Cl. ..... 248/235; 248/250; 248/248; 182/45; 108/42; 312/245; 211/88.01; 211/135

(58) Field of Classification Search ..... 248/235, 248/247, 248, 250, 223.41, 224.8, 222.51, 248/488, 490, 238, 236, 237, 48.1; 211/88.01, 211/90.01, 126.1, 126.16, 134, 125, 153; D6/511, 492, 553, 574; 108/42; 312/245; 182/45, 120

See application file for complete search history.

(56) References Cited

U.S. PATENT DOCUMENTS

| | | | | | |
|---|---|---|---|---|---|
| 778,719 | A | * | 12/1904 | Stephenson | 248/214 |
| 1,279,554 | A | * | 9/1918 | Knapp | 434/417 |
| D162,842 | S | * | 4/1951 | Klein | D25/119 |
| 2,565,014 | A | * | 8/1951 | Beaty | 118/500 |
| D165,038 | S | * | 10/1951 | Windhorst | D19/52 |
| D165,675 | S | * | 1/1952 | Westernacher | D6/467 |
| D173,773 | S | * | 12/1954 | Westernacher | D6/466 |
| 2,872,744 | A | * | 2/1959 | Dallen | 434/417 |
| D249,953 | S | * | 10/1978 | Drake | D19/91 |
| 4,228,982 | A | | 10/1980 | Sellera | |
| 4,241,510 | A | | 12/1980 | Radecki | |
| 4,530,482 | A | | 7/1985 | Berinson | |
| 4,597,554 | A | | 7/1986 | James | |
| 4,606,526 | A | | 8/1986 | Rabinowitz | |
| 4,712,761 | A | | 12/1987 | Wassell | |
| 4,843,977 | A | * | 7/1989 | Bridges | 108/152 |
| D311,657 | S | * | 10/1990 | Pate | D6/574 |
| 5,103,573 | A | | 4/1992 | Ehling et al. | |
| 5,103,574 | A | | 4/1992 | Levy | |
| D344,423 | S | * | 2/1994 | Pate | D6/511 |
| D344,424 | S | * | 2/1994 | Pate | D6/511 |
| D345,268 | S | * | 3/1994 | Pate | D6/511 |
| 5,451,027 | A | | 9/1995 | McHenry | |
| 5,454,542 | A | | 10/1995 | Hart | |
| 5,669,593 | A | | 9/1997 | Kirchner | |
| 5,803,425 | A | | 9/1998 | McCoy, II | |
| 6,070,847 | A | | 6/2000 | Kirchner | |
| 6,092,676 | A | * | 7/2000 | Graham | 211/94.01 |
| 6,095,478 | A | | 8/2000 | Barnes | |
| 6,119,999 | A | | 9/2000 | Fleishman | |
| D436,782 | S | * | 1/2001 | Rapp | D6/574 |
| 6,450,471 | B1 | * | 9/2002 | Wear | 248/489 |
| 6,557,813 | B1 | | 5/2003 | Duggan | |
| 6,585,218 | B1 | | 7/2003 | Friberg | |

(Continued)

*Primary Examiner* — Kimberly Wood
(74) *Attorney, Agent, or Firm* — Kinney & Lange, P.A.

(57) ABSTRACT

An apparatus for mounting an object to a wall includes a backbone, a ledge, and a spacer. The backbone has a means for mounting the backbone parallel to the wall. The ledge is attached to a bottom of the backbone and extends away from the wall. The spacer is located between the backbone and the ledge. A bottom of the object rests on the ledge and leans over the spacer such that a top of the object rests on the wall above the backbone.

8 Claims, 26 Drawing Sheets

U.S. PATENT DOCUMENTS

| | | | | |
|---|---|---|---|---|
| 6,739,065 | B2 | 5/2004 | Hofmeister et al. | |
| 6,783,106 | B2 | 8/2004 | Barnes | |
| 6,978,551 | B2 | 12/2005 | Krake et al. | |
| 7,028,619 | B2 | 4/2006 | McLemore | |
| 7,614,350 | B2 * | 11/2009 | Tuttle et al. | 108/23 |
| 2002/0043599 | A1 | 4/2002 | Pando | |
| 2002/0078582 | A1 | 6/2002 | Krake et al. | |
| 2003/0051363 | A1 | 3/2003 | Hofmeister et al. | |
| 2004/0026593 | A1 | 2/2004 | Fay | |
| 2004/0098875 | A1 | 5/2004 | Gould | |
| 2004/0140413 | A1 | 7/2004 | Dodig, Jr. | |
| 2004/0173546 | A1 | 9/2004 | Nagel | |
| 2004/0195192 | A1 | 10/2004 | Belokin et al. | |
| 2004/0195194 | A1 | 10/2004 | Belokin et al. | |
| 2005/0001136 | A1 | 1/2005 | Fleishman | |
| 2005/0127263 | A1 | 6/2005 | Lemire | |
| 2005/0178942 | A1 | 8/2005 | Dodig, Jr. | |
| 2005/0218287 | A1 | 10/2005 | Strobel | |
| 2006/0075650 | A1 | 4/2006 | Tatum | |

* cited by examiner

APPARATUS AND METHOD FOR DISPLAYING PICTURES AND FLAT ART OBJECTS

CROSS-REFERENCE TO RELATED APPLICATION(S)

This application is a continuation of U.S. patent application Ser. No. 29/281,161 filed Jun. 15, 2007, which is hereby incorporated by reference.

BACKGROUND

The present invention relates generally to an apparatus and method for displaying pictures and more specifically, to an apparatus and method for attaching pictures to a wall or other vertical support.

U.S. Pat. No. 5,451,027 to McHenry describes a device with upper and lower linear edges that are connected in parallel fashion to each other. Both the top and bottom are slidable to vary the distance between the edges and the bottom member to allow for different size picture frames and has a number of slots for attaching it to the wall.

U.S. Pat. No. 5,454,542 to Hart describes apparatuses and methods for hanging frames with a body and a protruding supporting rail that attaches the apparatus to the frame and has adaptor brackets for various sizes of frames.

U.S. Pat. No. 5,669,593 to Kirchner describes a hanging device with a wall mount that has an adjustable weight device for hanging pictures. This adjustable weight device is slidable for desired positioning of the picture.

U.S. Pat. No. 5,803,425 to McCoy II describes a wall handing device with a back plate with a front surface and two rear surfaces that form a slot. The slots are spaced to provide friction between a cord attached to the framed work and the device.

U.S. Pat. No. 6,070,847 to Kirchner describes a hanging device that has a wall mount and an adjustable picture mounting device using a mechanism that can be threadably or frictionally positioned.

U.S. Pat. No. 6,095,478 to Barnes describes a picture hanging system including at least one slot in a picture frame rail. This allows for the picture frame to be hung flush and secure on the wall without the need for a tool.

U.S. Pat. No. 6,119,999 to Fleishman describes a picture hanging system comprising a rod from which one or more pictures are suspended by a pair of wires or cables.

U.S. Pub. No. 2002/0043599 to Pando describes a device and methods using a motorized suction device to support one or more articles (pictures) above the ground using a shelf, a channel, a magnet, a ring, a hook and loop fastener or a hook.

U.S. Pub. No. 2002/0078582 to Krake describes a picture hanging device with a body and at least one marking element for marking a wall.

U.S. Pat. No. 6,783,106 to Hofmeister describes a wall hanging device with a hanger body and a prong element. The hanger body is adapted to attach to the rear of the wall article and contains opposing slots to receive the prong element.

U.S. Pub. No. 2003/0051363 to Hofmeister describes a device for marking a point on a wall where a fastener should be installed at a desired location on the wall. It uses an elongated frame and an elongated slot and has a ledge that is positioned on top of the object and a pin that affixes to one or more stylus.

U.S. Pat. No. 6,557,813 to Duggan describes a device with a vertical guide and horizontal rail that is adjustable up and down. The guide is fixed to the wall and the rail is fixed to the back of the picture being hung.

U.S. Pat. No. 6,485,218 to Friberg describes a picture stand with an upper and lower portion in which the lower portion is engaged on top of a horizontal surface such as a desk. The picture stand leans over to pick up the picture and then is placed against the wall in a vertical fashion.

U.S. Pub. No. 2004/0026593 to Fay describes a picture hanging system with a permanently installed array of tensioned vertical cables spaced at uniform intervals and attached at both the top and the bottom to a wall for displaying pictures.

U.S. Pub. No. 2004/0098875 to Gould describes a picture placement apparatus providing an accurate mark on the wall for placing an anchor to hold up the picture.

U.S. Pat. No. 6,739,065 to Hofmeister describes a device for use in marking a point on a wall where a fastener should be installed in order to hang an object on a desired location on the wall.

U.S. Pub. No. 2004/0173546 to Nagel describes a display rack assembly for display of product packages with a spring-loaded pusher to enable a standardized display rack to be adapted for wider or taller packages.

U.S. Pub. No. 2004/0195192 to Belokin describes display hook assemblies provided with a removable display panel on the forward edge of a merchandise display shelf.

U.S. Pub. No. 2004/0195194 to Belokin describes shelf units adapted to be mounted on vertical walls for displaying merchandise adapted to utilize removable hooks for cross-merchandising complementary products.

U.S. Pub. No. 2005/0127263 to Lemire describes a picture hanging system that utilizes brackets and hanger bodies that are attached to a picture. The brackets supports either the lip on the hanger body, threaded screws, hooks, or screws in the hangers for mounting the object and locking it into place U.S. Pub. No. 2005/0218287 to Strobel describes a device and method for locating the point on a wall at which a nail or other wire suspending element is installed for hanging a picture. The device includes a retrieval arm that is operable for engaging the framing wire of a picture and a wall striking element operable for marking on a wall the place for a nail or other hardware to be secured.

U.S. Pat. No. 6,978,551 to Krake describes a picture handling device with at least one marking element from one side of the body for marking the wall. The body has a flexible portion to assist with the marking.

U.S. Pub. No. 2006/0075650 to Tatum describes an apparatus and methods for precisely locating and marking where to fasten an object.

U.S. Pat. No. 7,028,619 to McLemore describes a personal display shelf having a vertical support surface base and horizontal transparent shelves for display of various collectible objects.

U.S. Pat. No. 4,228,982 to Sellera discloses an apparatus composed of two separate elements: one element to be attached to a wall, and the other specially adapted companion element necessarily attached to the frame to be hung.

U.S. Pat. No. 4,530,482 to Berinson discloses an apparatus for hanging framed pictures consisting of a lengthy resinous strip to be attached to the wall and picture mounts with sharp edges to be attached to picture frames. The sharp edges of the picture mounts are then inserted between the strip and wall to hang picture frames. The apparatus necessarily includes a specially adapted element to be attached to the frame to be hung.

U.S. Pat. No. 4,597,554 to James also describes an apparatus consisting of a matched pair of fixture members, one of which must be attached to the picture frame.

U.S. Pat. No. 5,103,573 issued to Ehling et al. describes a picture hanging device having holes arranged for the purpose of placing nails on both sides. This device includes measuring indicia and a bubble level. A notch is provided so as to allow for a proper centering of the device. Conventional picture hooks are frictionally engaged at predetermined points along the upper edge of the device by a rod which is attached to the device parallel to and spaced apart from the upper edge.

U.S. Pat. No. 4,241,510 issued to R. P. Radecki teaches an aid for hanging a picture with a pair of adjustable sliding guides for the placement of nails. This device also employs a bubble level. Slide members are carried on the cross arms to engage a hanging wire. Locating marks on the neck part indicate the top of the picture and are used to position the device at a desired wall location for the picture with the slide members locating the hangers, such as hooks.

SUMMARY

In one embodiment, an apparatus for mounting an object to a wall includes a backbone, a ledge, and a spacer. The backbone has a means for mounting the backbone parallel to the wall. The ledge is attached to a bottom of the backbone and extends away from the wall. The spacer is located between the backbone and the ledge. A bottom of the object rests on the ledge and leans over the spacer such that a top of the object rests on the wall above the backbone.

In another embodiment, the ledge has a bottom potion and a top portion attached to one end of the bottom portion at approximately right angle. The spacer has a far end attached to the top portion of the ledge and a near end perpendicularly abutting the wall. The backbone is attached at an approximately right angle to the spacer. The backbone extends upwardly, parallel to the wall and having means for mounting the apparatus to the wall. Placement of the object on the bottom portion of the ledge will cause the object to lean back over spacer to rest again wall.

DETAILED DESCRIPTION

Advantages

Figure 1:
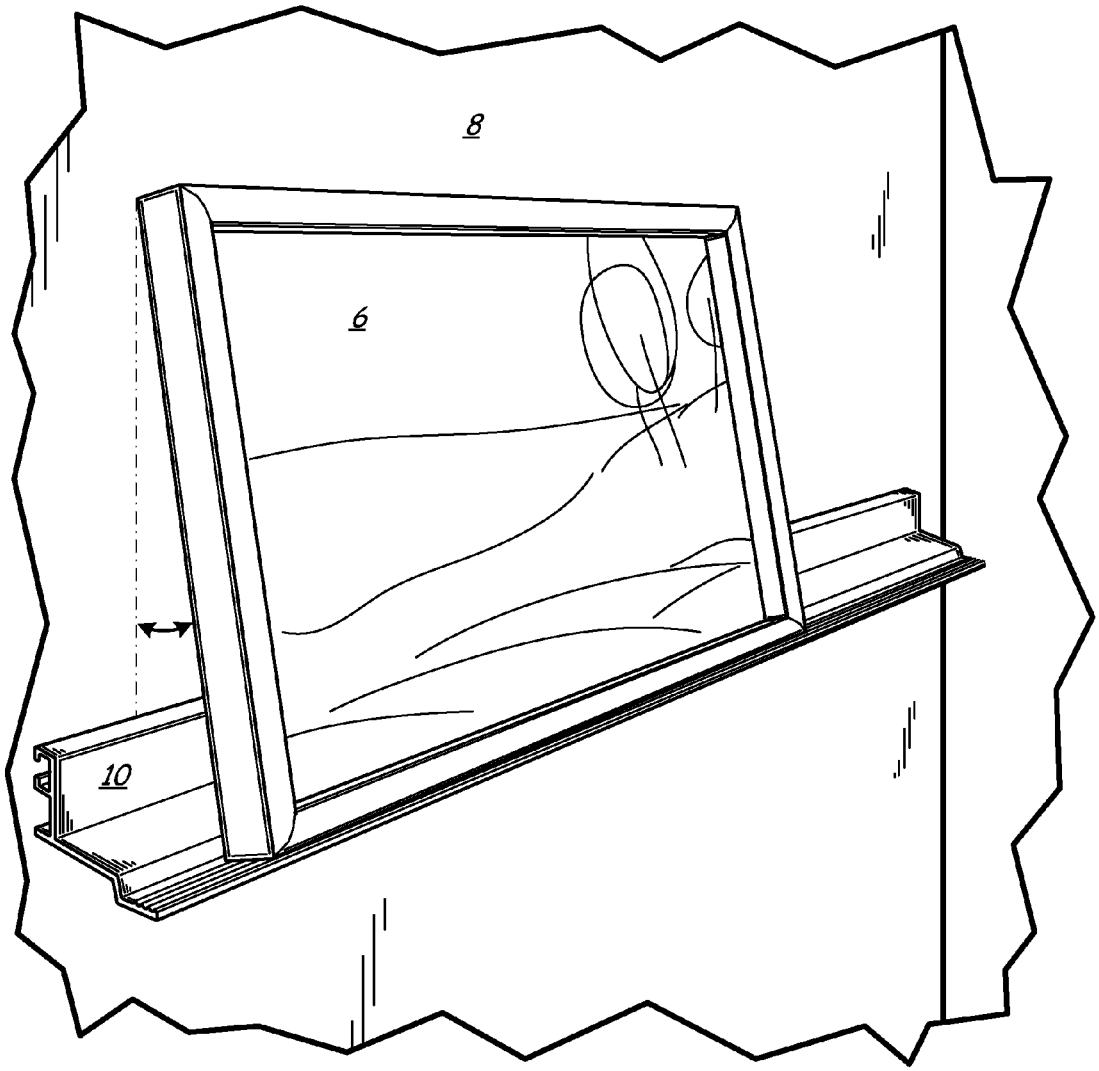
FIG. 1 is a perspective view of a first embodiment of an apparatus mounted to a wall and displaying a picture in accordance with the present invention.

There remains a need for an improved means for displaying pictures and other art works, one that assures that the work is easily placed in the mounting structure, allows the part to be stable and easily removed and remounted for cleaning or re-arrangement of pictures. They also need to be vertical with respect to each other for demonstrating an organized and pleasing display instead of one that can allow the picture to move and become slightly off from vertical. The present invention fills the need by providing a simple, inexpensive, and easy-to-use apparatus and method that permit the user quickly and securely to mount a frame upon a wall or other vertical surface. Practicing the present invention, the user can consistently hang one or more pictures on the level, with the top and bottom edges of the frame in a pleasantly horizontal aspect with very easy removal and replacement and a pleasant structure that complements the picture display.

Previous patents deal with various methods and apparatuses that help to secure the pictures as well as improving the ability to mark the wall properly for proper hanging. Since the invention has a ledge on it for holding the pictures, shelves for displaying various parts were also explored, but none considered the need for easy placement of pictures on the mounting device that is secured to the wall as does the current invention with the advantages of stability, attractive presentation of the device itself and easy load and unload of one or more pictures The present invention relates to devices and methods used in the displaying of pictures and related art objects. Most of these methods would be classified as hanging of pictures. However, the present invention does not hang the picture, but rather allows the picture to be placed on a structure that is hung to the wall. The picture itself is secured by the angle and distance from the wall that is provided in the invention. It allows for stable, simple, horizontal placement with near vertical display of one or more pictures on the device.

Initially, the present invention was designed as an object that would allow for the mounting of smaller flat art objects such as plaques, awards, and smaller pictures (9"×12" and below) to a wall. Additionally, the corollary object was to have a mounting apparatus and method that would prevent the movement of pictures in a hanger which causes them to change from their vertical, more visually appealing orientation. As the design matured, additional advantages were realized, such as the ease of loading and unloading that gave rise to two additional advantages. First, the picture can be removed easily for cleaning and/or dusting. Secondly, it is now very easy for the user to change their pictures according to the season, visitors that may prefer a certain kind of artwork, or simply for variety of the look in a room. This invention continues to be especially advantageous for offices or houses where there are a number of plaques or awards to display. The additional advantage of being able to have more than one of the invention pieces mounted on the wall next to each other creating an extended device for mounting various pictures. Additionally, it has been determined that larger pictures and heavier pictures can easily be handled by the device (such as picture frames that are up to 36" high and can weigh up to 50 pounds.) Additionally, the device is designed to be made out of materials that can either match the picture frame or complement it. For example, the preferred embodiment can be made from metal such as Aluminum which can be anodized to various colors (silver, gold, black, . . . ) or other metals which can be powder coated with various colors. These colors can match or complement the picture frame. Additionally, it can be made of high quality wood which is milled out, stained, and finished to provide an aesthetically appealing fixture for displaying the picture.

The invention involves an apparatus and method for holding picture frames, plaques, bulletin boards or other flat art objects. The apparatus can be made in multiple sections or as a single piece. In any case, it contains an interface for securing it to a wall, which is referred to as the backbone. The backbone contains a mounting trough that mounts the overall apparatus to the wall by sliding over screw heads, nail heads or other fastener that is placed on the wall. Further more, it has a spacer that positions the art object away from the wall a specified distance and allows the object to be slanted toward the wall. Thirdly, it has the resting ledge which is roughened and slanted for direct placement of the art object. This apparatus design allows for simple placing of various size art objects on this structure in an organized and stable configuration. Interchangeability of art objects is made very easy since removal of an existing object is done be lifting the object off the resting ledge and putting the new object in its place. An apparatus in accordance with the present invention does require difficult handling or special tools. The invention provides a ledge that is positioned a distance away from the wall that is slanted along with the connection to the spacer to allow a picture to be hand loaded onto the ledge and allow the top portion of the picture to lie softly against the wall.

The apparatus can be formed from metals of various types or high strength plastics. Metals could be Carbon Steel, Stainless Steel, Aluminum, or others. The colors of the material can be altered due to various process such as anodizing, plating, or powder coating that can yield a variety of colors; gold, clear, black, blue, red, green, and many others. There are many metal picture frames in use which have the same color potentials and thus the apparatus can be made from the very same color as the frame itself or a complementary color of the user's choosing. The product can be cut to any length following extrusion. However, by using 2 foot and 3 foot examples, it is possible to extend the design for holding multiple pictures at lengths from 2 foot to an infinite length in one foot increments.

The primary advantages of this product are many. First of all, the design provides precise alignment at the bottom of all of the pictures that are place on the sloped ledge. The rigidity and strength of the design enables it to hold pictures up to 50 pounds (or 22 kilos). The unique mounting of the picture prevents the picture from being altered from a horizontal oriented position to having one side of the picture higher than the other side in case of wind or vibration that can cause the pictures that are hung on hooks to move in this way. This is especially true for pictures that are hung with wire on a hook. The apparatus itself is easily placed on screw or nail heads through use of the mounting channel or by placing screws or nails through the holes in the backbone. Once these are in place, the pictures are all held in a horizontal, stable position until the user wants to change them.

One of the features of this design is the ability to change the apparatus itself. This is especially true for the option of using the mounting trough. The apparatus can simply be slid laterally to remove it from the screw heads, nail heads or hooks and another apparatus of a different length or color can be slid back over the screw heads, nail heads or hooks. This process only takes a few seconds and allows the user to adapt to any desires to change the interior design of the room in a very short time. Furthermore, the simplicity of removing and replacing pictures on the slanted ledge is even easier and allows for quick and efficient interior design changes as well as allowing for cleaning of the pictures.

It has already been pointed out that the word picture in this document is meant to describe pictures that could be drawings, paintings, or photographs. They can be mounted on press board, simply in a stretched canvass, or in various picture frame forms. Additionally, it also includes bulletin boards, white boards, as well as various art objects, such as decorator plates, or other flat art forms. All of these parts can be easily and securely placed on the slanted ledge for display with an enhanced visual effect. The display is at a modest angle, but continues to provide a pleasing view of the 'picture'. In the case of some of the decorator plates, it may be advisable to have a deeper (longer dimension) for the slanted ledge and/or the addition of the front lip to secure the device if the plate has a significant distance between the back of the plate and the front edge.

Definitions

Wall—Not part of the invention; just refers to the vertical wall or structure to which the invention is attached. It can consist of various materials including sheet rock, wood or composition paneling, pegboard, wafer-board, plywood, or other similar materials.

Backbone—the flat portion of the device which is mounted onto the wall and provides the ability to fasten the device to the wall while being attached to the rest of the picture ledge.

Mounting trough—This trough is positioned between the back wall of the device and the wall itself. It provides for a method of sliding the trough over screw, nail heads or mounting hooks to fasten the device to the wall directly.

Mounting holes—These holes are drilled, molded in, or otherwise machined in the backbone which may include the mounting trough or could eliminate the mounting trough altogether in one of the embodiments.

Spacer—The spacer is the connection between the backbone and the ledge and is the major portion that defines the distance that the bottom of the picture frame or plaque is positioned away from the wall.

Ledge—The ledge on which the picture fame or plaque rests.

Picture—The word "picture" is defined in Webster's New Collegiate Dictionary as "a design or representation made by various means (as painting, drawing, or photography)." The picture as described in this document can be canvas on a stretched frame, poster board, or in a decorative frame of wood, metal, ceramic or other similar material. Furthermore, in the context of this patent application, picture would also refer to plaques, bulletin boards, white boards, black boards, decorative plates, and other art pieces.

Roughened surface—This refers to the top surface of the ledge where there are ridges, a roughened surface through bugging or grinding, or the addition of a non-slip rubber type material that is attached to the slanted ledge with an adhesive.

Features

A picture frame or plaque holder that is attached to the wall and provides for picture or plaque to be placed by the hand on the holder and lean against the wall.

The picture frame or plaque holder holds the bottom of the picture on a ledge.

The picture frame or plaque holder has a spacer that positions the bottom of the picture frame or plaque at a distance away from the wall so that it securely rests against the wall.

The picture frame or plaque holder is milled or carved from a solid wood block of maple, birch, oak, cherry, walnut, mahogany or similar wood materials.

The picture frame or plaque holder is made of wood that is milled or carved out in two or more pieces then assembled through use of gluing, doweling, and/or other fastening.

The picture frame or plaque holder is made of aluminum or other metals through the use of extrusion techniques.

The picture frame or plaque holder is made of plastic through the use of extrusion or molding techniques.

The picture frame or plaque holder is made of glass.

The picture frame or plaque holder is made of ceramic or ceramic-like materials.

A picture frame or plaque holder having a back that is attached to the wall with a trough that slides along screw heads attached to anchors, nail heads, hanging hooks and the like with a spacer that positions the bottom of the picture frame or plaque at a distance away from the wall so that it securely rests against the wall that is milled or carved from a solid wood block of maple, birch, oak, cherry, walnut, mahogany or similar wood materials.

A picture frame or plaque holder having back that is attached to the wall with a trough that slides along screw heads attached to wall anchors, nail heads, hanging hooks and the like with a spacer that positions the bottom of the picture frame or plaque at a distance away from the wall so that it securely rests against the wall and has a slanted ledge and a spacer that holds the picture frame or plaque away from the wall so that top of the picture frame or plaque rests against the wall.

The picture frame or plaque holder is milled out from a solid wood block of maple, birch, oak, cherry, walnut, mahogany or similar wood materials.

A picture frame or plaque holder that is attached to the wall and has a slanted ledge of between 4 and 12 degrees from horizontal and has a spacer that holds the picture frame or plaque at a distance of between 0.40" and 2.0".

The picture frame or plaque holder has a ledge on which the picture frame or plaque rests. The ledge has ridges, a roughened surface, or a rubberized this layer to prevent slippage.

The picture frame or plaque holder includes a retaining lip that is either vertical, at a right angle (±10 degrees) to the slanted ledge that assists to prevent the picture frame from sliding forward and falling off the ledge. When the retaining lip is used the slanted ledge can be used at an angle of 0 degrees (no slant) to 12 degrees and any slant in between.

The picture frame or plaque holder includes holes that are drilled or otherwise formed in the back of the invention which are lined up with the open part of the trough for installation of a nail, screw, or other fastener that can extend through this hole to interface with the wall or other vertical surface on which the picture is to be mounted.

The method of placing the picture frame or plaque on a slanted ledge that is positioned at a distance of 1.2 inches plus or minus 0.8 inches from the wall providing a secure, free standing position for the picture frame or plaque due to the center of mass of these objects (picture frame or plaque) being at approximately half of this positioning distance.

The slant on the ledge that is between 4-12 degrees from vertical toward the wall.

A frictional resistance such as a roughened surface, the addition of ridges or having a non-slip rubberized material that is fastened with an adhesive to the slanted ledge to prevent the forward slippage of the picture frame or plaque.

The method of placing the devices in proximate positions on the left and/or right of the first device that is mounted on the wall. Since the device can be made in any length, this would provide for extended lengths in increments of the particular lengths that are made. An example would be the currently manufactured examples of the preferred embodiment which can be slid together (or mounted together in the case of the through hole mounting) from end to end making an overall device for placement of pictures that can stretch from two feet to infinity as it is initially made in two lengths of 2 feet and 3 feet. Thus, the 2 foot length part can be used, or the 3 foot part can be used. For a 4 foot overall length, two of the 2 foot parts can be slid or mounted together end to end. For a 5 foot overall length, a 2 foot part and a 3 foot part can be slid or mounted together end to end. For a 6 foot overall length, two of the 3 foot parts can be slid or mounted together end to end, and so on.

Embodiments

FIG. 1 is a perspective view of framed picture 6 supported against wall 8 by mounting apparatus 10. Mounting apparatus has a vertical portion for mounting to wall 8 and a horizontal portion for supporting framed picture 6. A bottom of framed picture 6 rests on a forward edge of the horizontal portion of the mounting apparatus 10. From this supported position, framed picture 6 leans rearward over both rearward edge of the horizontal portion and vertical portion of mounting apparatus 10. A top of frame picture 6 is situated above the vertical portion of mounting apparatus 10 and resting against wall 8.

Figure 2:
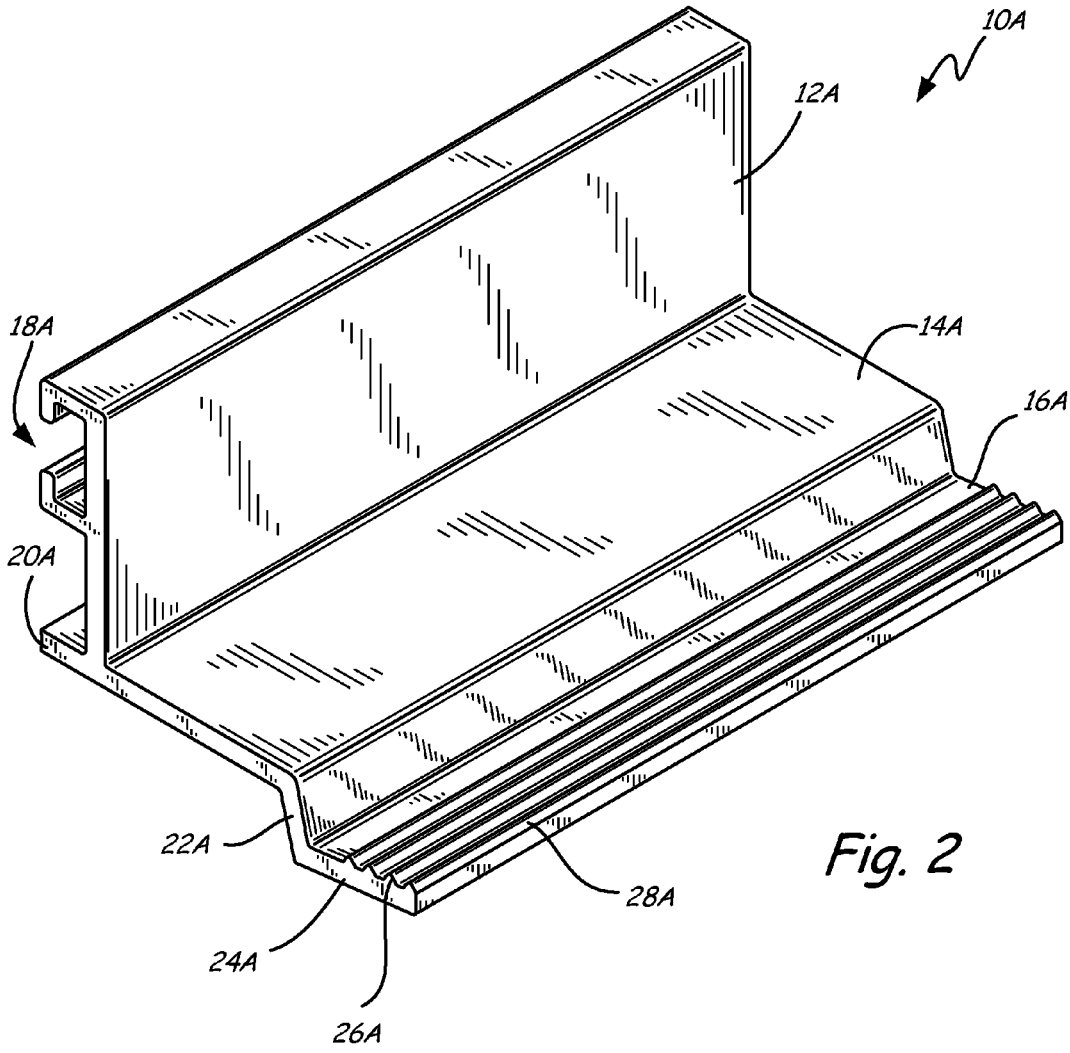
FIG. 2 is a perspective view of the first embodiment of the apparatus for displaying pictures and flat art objects from FIG. 1 with the wall and the picture removed.
Figure 3:
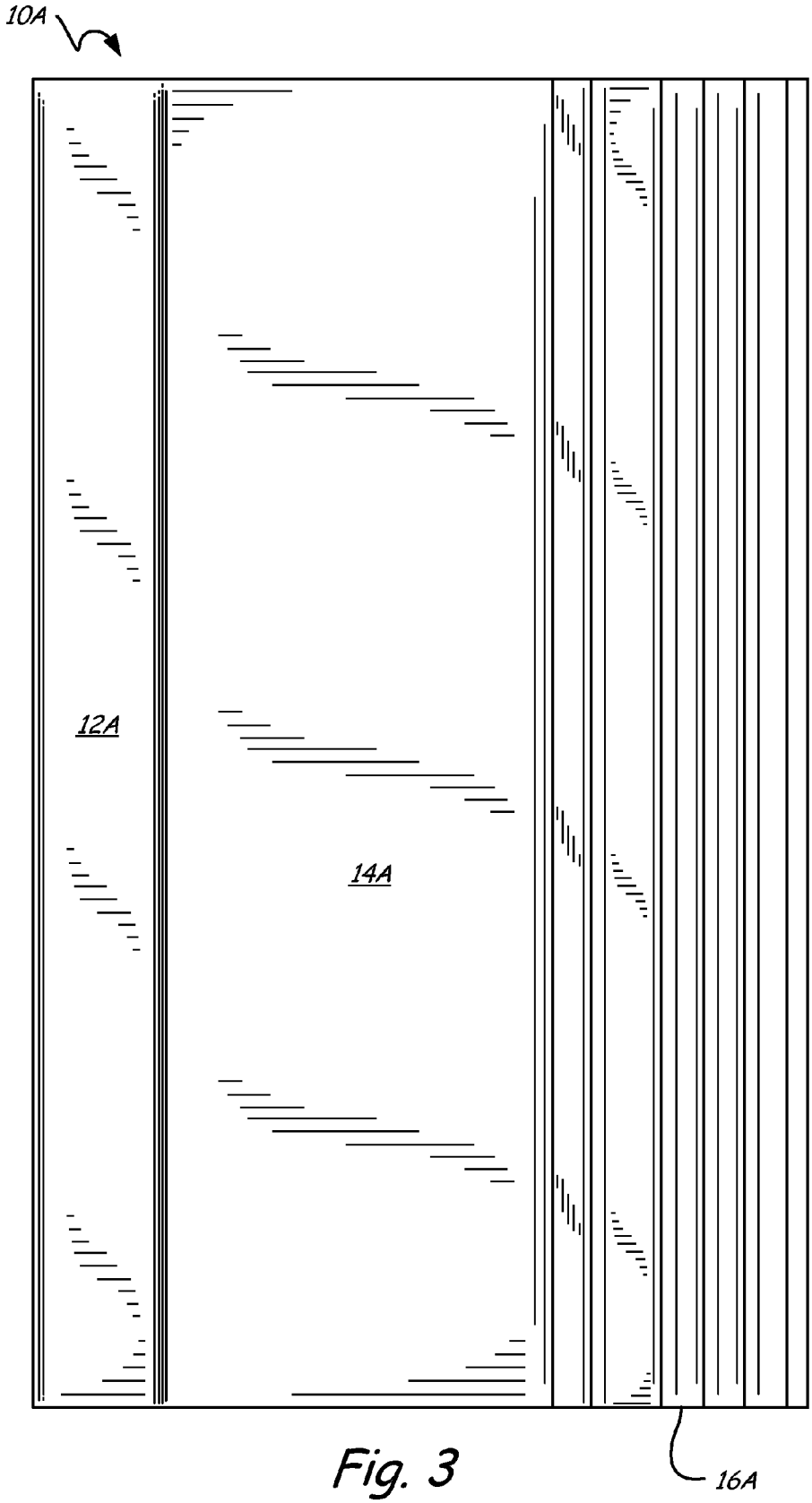
FIG. 3 is a top plan view of the first embodiment from FIG. 1-2.
Figure 4:
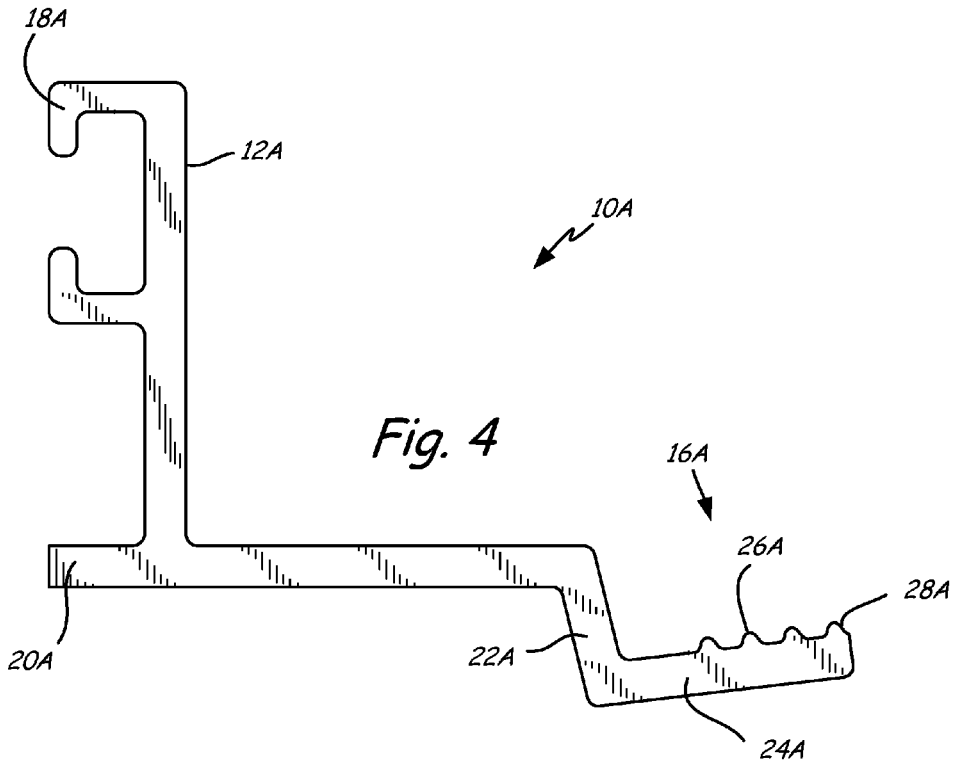
FIG. 4 a right side view of the first embodiment from FIGS. 1-3.
Figure 5:
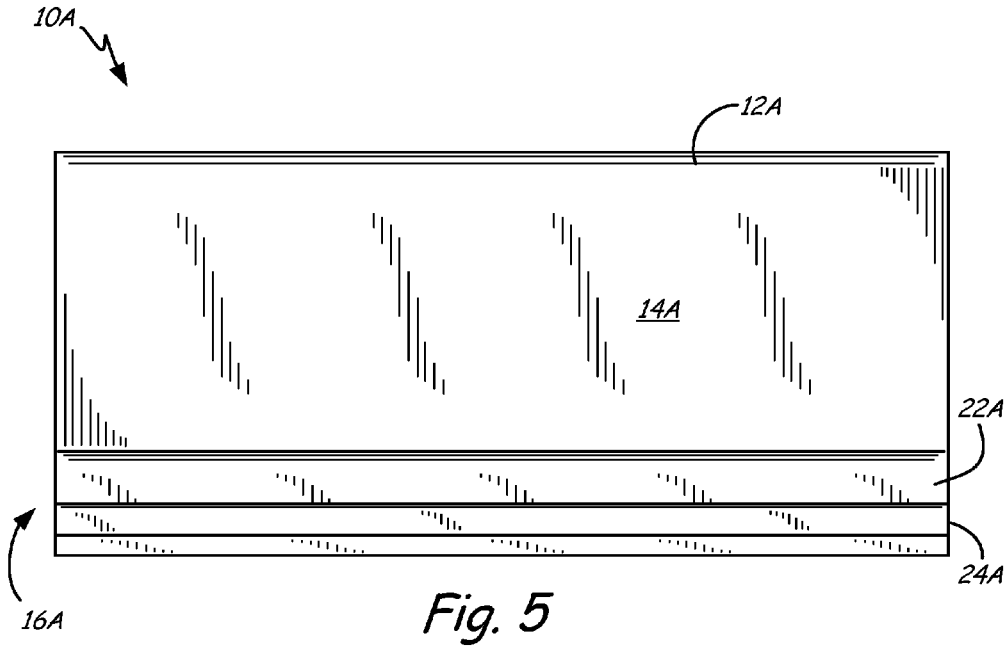
FIG. 5 is a front elevational view of the first embodiment from FIGS. 1-4.
Figure 6:
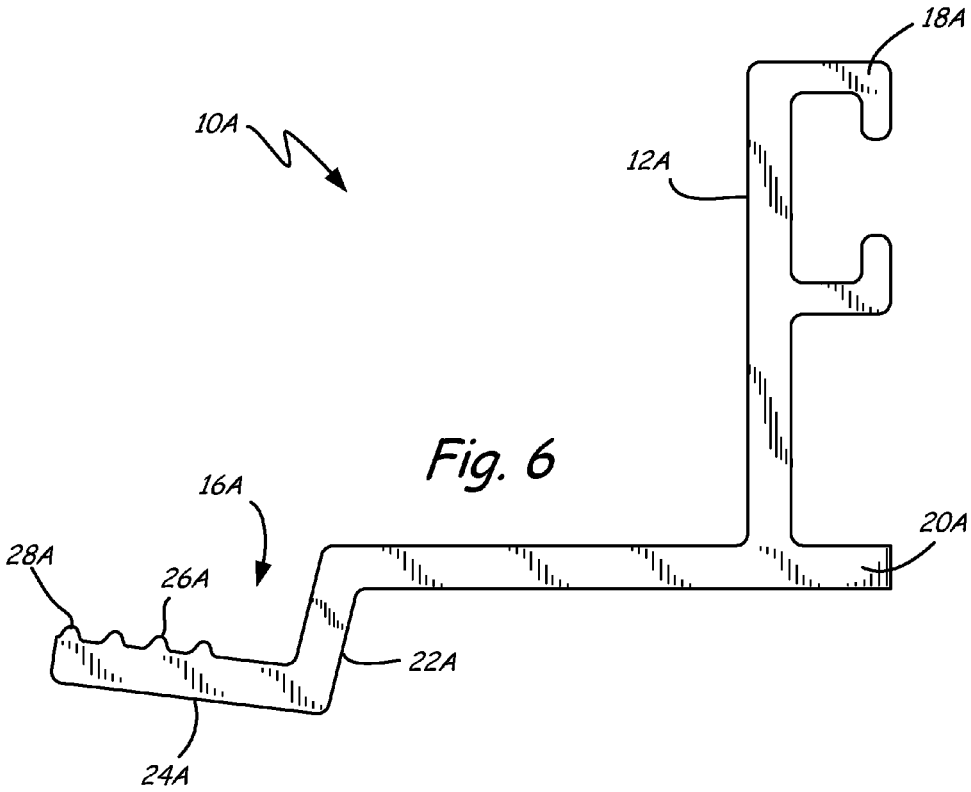
FIG. 6 is a left side view of the first embodiment from FIGS. 1-5.
Figure 7:
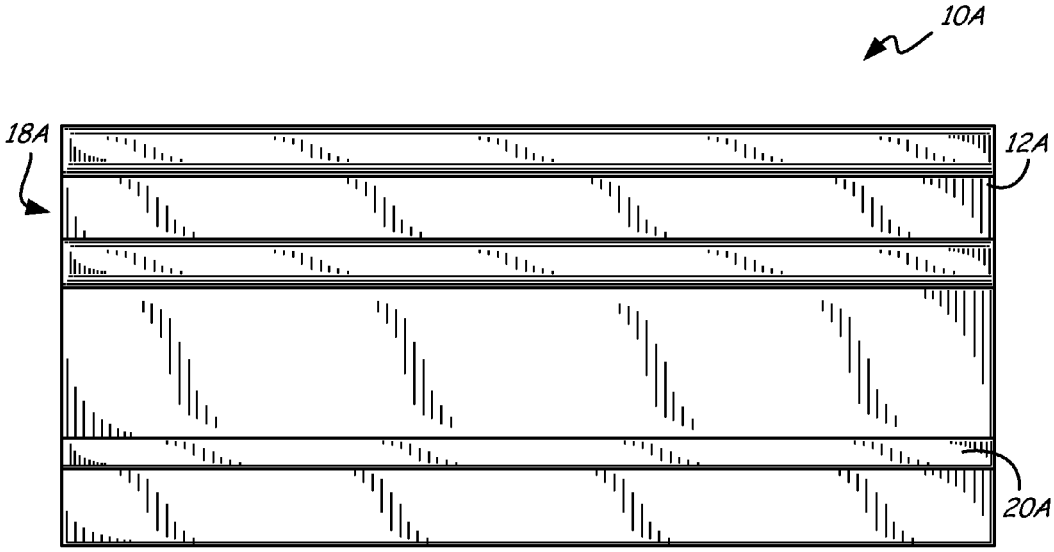
FIG. 7 is a rear elevational view of the first embodiment from FIGS. 1-6.
Figure 8:
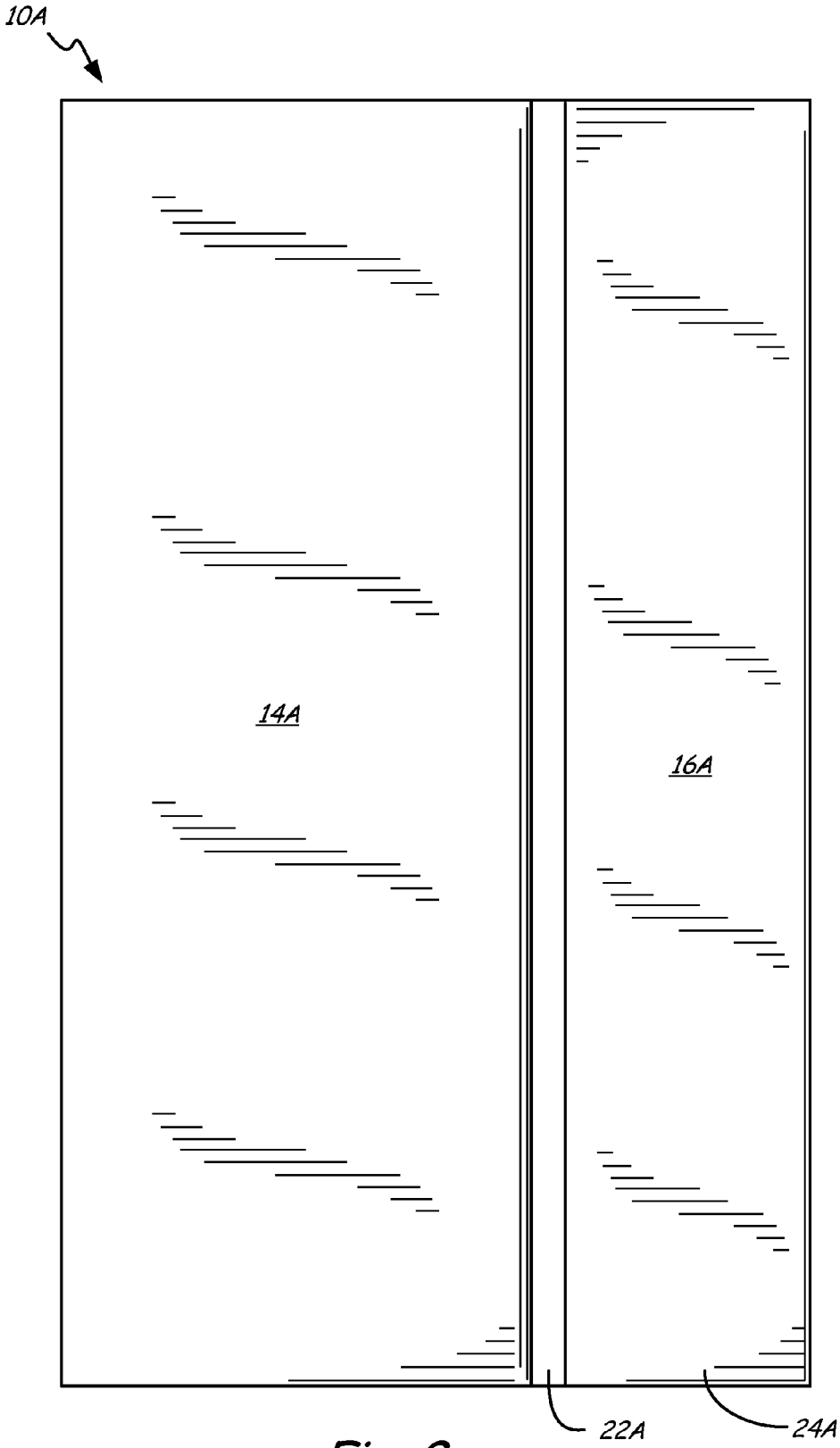
FIG. 8 is a bottom plan view of the first embodiment from FIGS. 1-7.

FIGS. 1-2 are perspective views, FIG. 3 is a top plan view, FIG. 4 is a right side view, FIG. 5 is a front elevational view, FIG. 6 is a left side view, FIG. 7 is a rear elevational view, and FIG. 8 is a bottom plan view of a first embodiment of mounting apparatus 10A for displaying pictures and flat art objects in accordance with the present invention. Mounting apparatus 10A includes backbone 12A, spacer 14A, and ledge 16A. Backbone 12A further includes mounting trough 18A and support 20A. Ledge 16A further includes top portion 22A, bottom potion 24A, ridges 26, and retaining lip 28A. Mounting apparatus 10A can be extruded from aluminum, plastic, or other materials that are both sturdy and light.

Backbone 12A extends vertically and spacer 14A extends horizontally with respect to a wall or support. A bottom of backbone 12A and a side of spacer 14A attach to one another and resemble the letter "L". Backbone 12A and spacer 14A are joined to one another at an approximately right angle (90 degrees). In the depicted embodiment, backbone 12A has a length of about 1.01 inches (2.57 cm) and spacer 14A has a length of about 0.92 inches (2.37 cm). Attached to the opposite side of spacer 14A is ledge 16A, which is slanted slightly upwardly (0-5 degree) off horizontal. A bottom of a picture or other flat art object is placed on ledge 16A such that the picture leans backwardly over spacer 14A and the top of backbone 12A such that the top of the picture rests against the wall.

Located at a top of backbone 12A and extending rearwardly about 0.24 inches (0.61 cm) toward wall is mounting trough 18A. In the depicted embodiment, mounting trough 18A resembles a backwards letter "C" and is configured to secure backbone 12A onto nails or screws or picture hanging hooks extending from a wall or other support. Mounting trough 18A is a horizontal T-shaped slot with a height of about 0.40 inches (1.07 cm), a width of about 0.24 inches (0.61 cm), and includes a central opening of mounting trough 18A of about 0.22 inches (0.56 cm). Mounting trough 18A further includes a channel having a width of about 0.13 (0.33 cm) for receiving the screws and retaining tips of about 0.17 inches (0.43 cm) at a top and bottom for retaining the screws in the channel. In an alternative embodiment, holes extend into mounting trough 18A and through backbone 12A for directed attached backbone 12A to a wall. Located at a bottom of backbone 12A and extending rearwardly, parallel to mounting trough 18A is support 20A. Support 20A is about 0.17 inches long (0.43 cm) and ensures the stability of mounting apparatus 10A.

Ledge 16A includes top portion 22A attached to spacer 14A, and bottom portion 24A attached to top portion 22A. A bottom of top portion 22A is attached to one side of bottom portion 24A at an approximately right (90 degree) angle. Top portion 22A has a length of about 0.325 inches (0.83 cm) and bottom portion 24A has a length of about 0.42 inches (1.07 cm) A top surface of bottom potion 24A includes a plurality of ridges 26A (or other means of friction) and an end of bottom portion 24A (opposite the attachment to top portion) includes retaining lip 28A. Both ridges 26A and retaining lip 28A stop any picture or other flat art object from slipping off of bottom portion 24A of ledge 16A. In use, the bottom of the picture is placed on bottom potion 24A of ledge 16A and is retained on bottom portion 24A by ridges 26A and retaining lip 26A. Ridges 26A extending vertically upwards from bottom ledge 16A. Retaining lip 28A has a height of about 0.4 inches (1.07 cm) and is perpendicular to bottom ledge 16A. The picture leans backwardly from the bottom surface such that a backside of the picture contacts top portion 22A of ledge 16A. Top portion 22A of ledge 16A places the picture at the desired angle with respect to the wall. The picture will continue to lean backwardly over spacer 14A until the backside or top of picture contacts backbone 12A. The width of spacer 14A will determine how far away from the wall the picture will reside. Mounting apparatus 10A has successfully mounted pictures having heights between about 5 and 30 inches (12.7-76.2 cm) to the wall.

Figure 9:
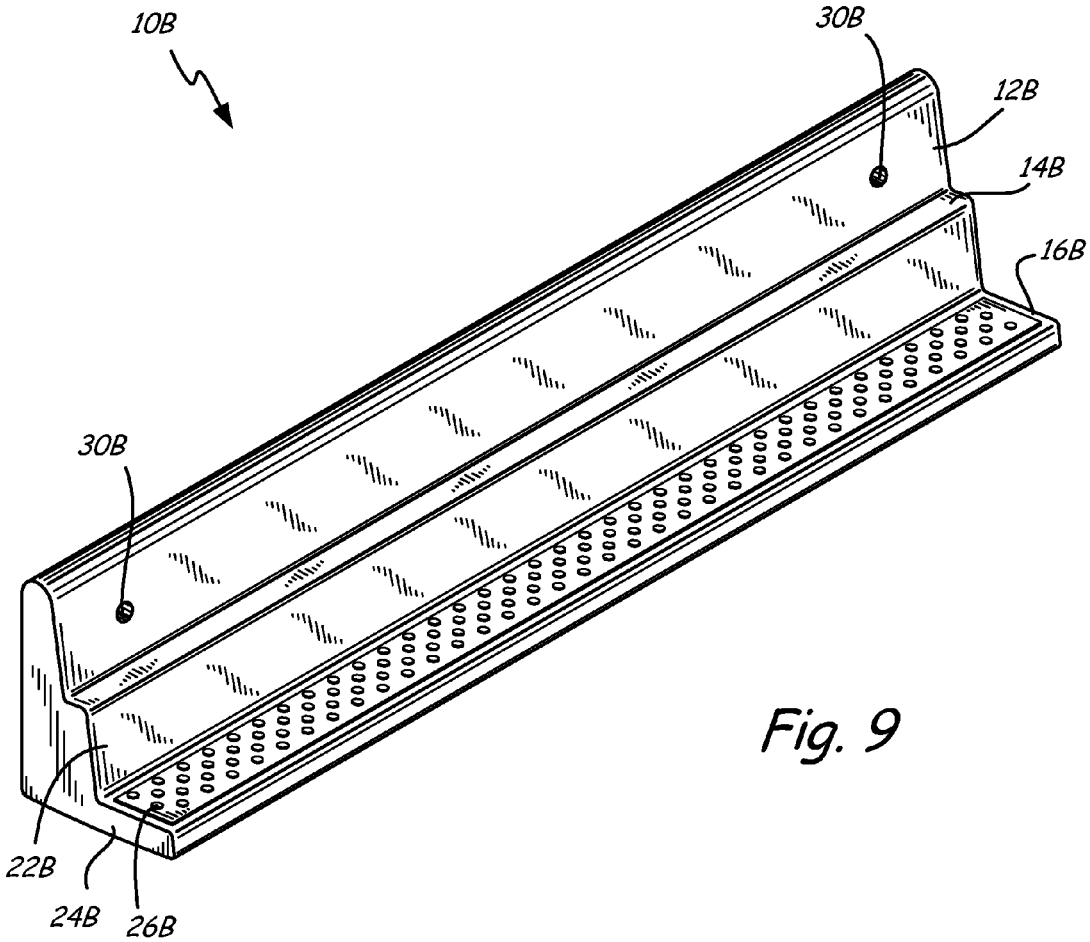
FIG. 9 is a perspective view of a second embodiment of an apparatus for displaying pictures and flat art objects in accordance with the present invention.
Figure 10:
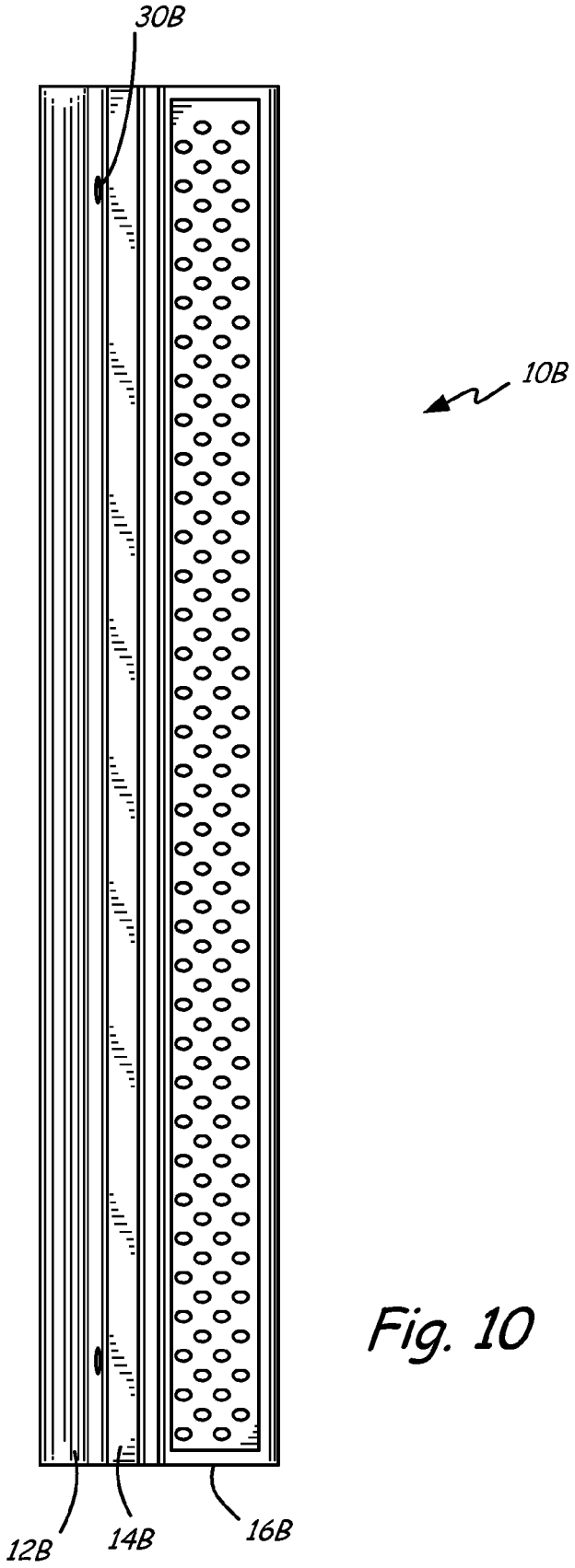
FIG. 10 is a top plan view of the second embodiment from FIG. 9.
Figure 11:
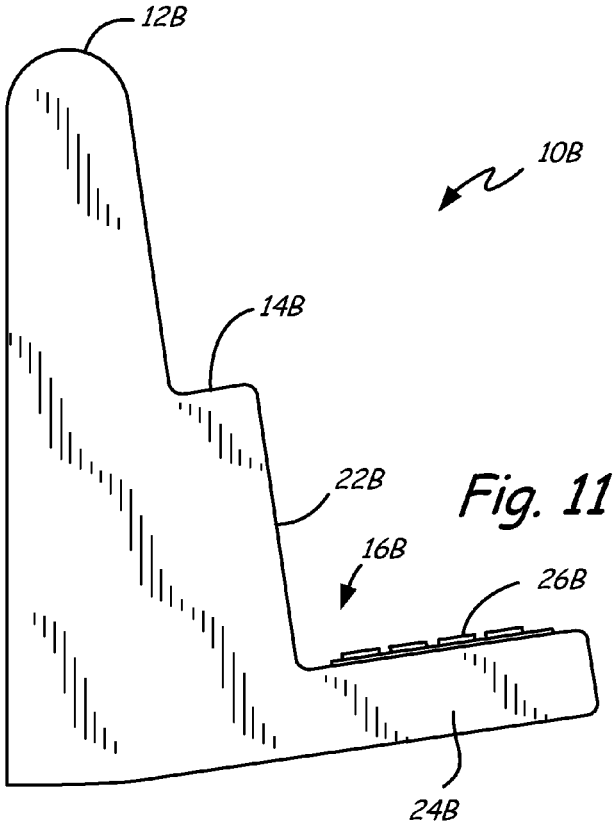
FIG. 11 a right side view of the second embodiment from FIGS. 9-10.
Figure 12:
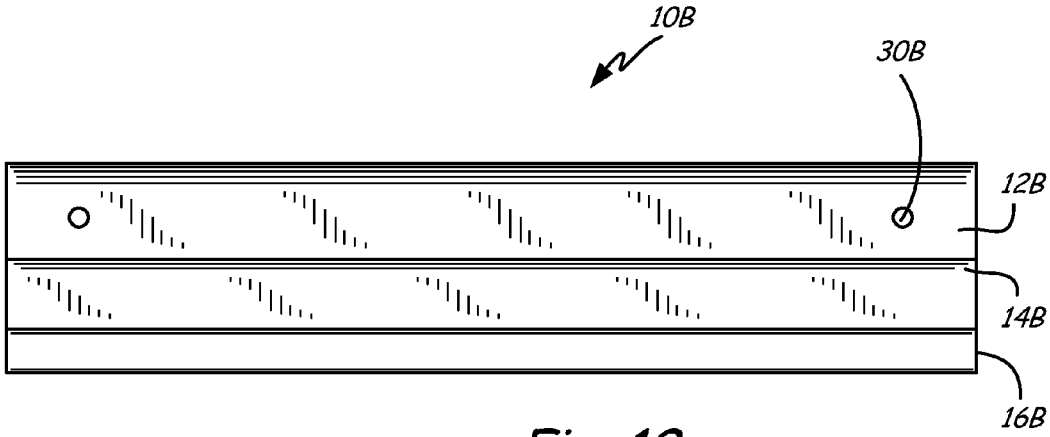
FIG. 12 is a front elevational view of the second embodiment from FIGS. 9-11.
Figure 13:
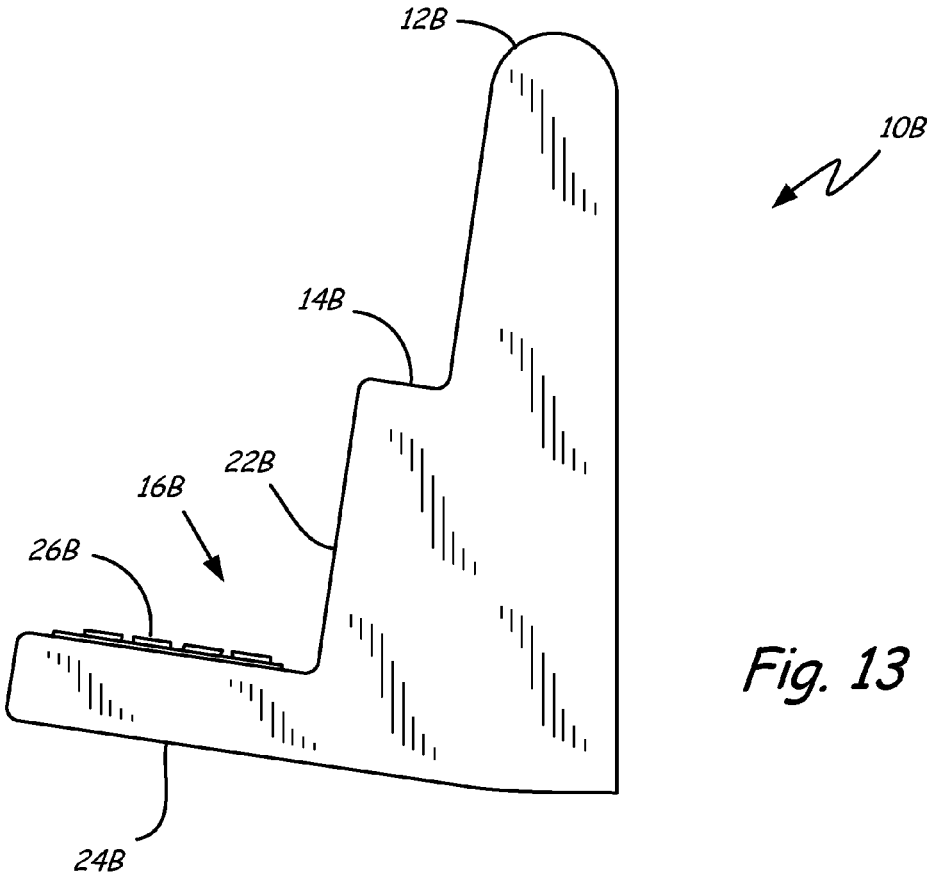
FIG. 13 is a left side view of the second embodiment from FIGS. 9-12.
Figure 14:
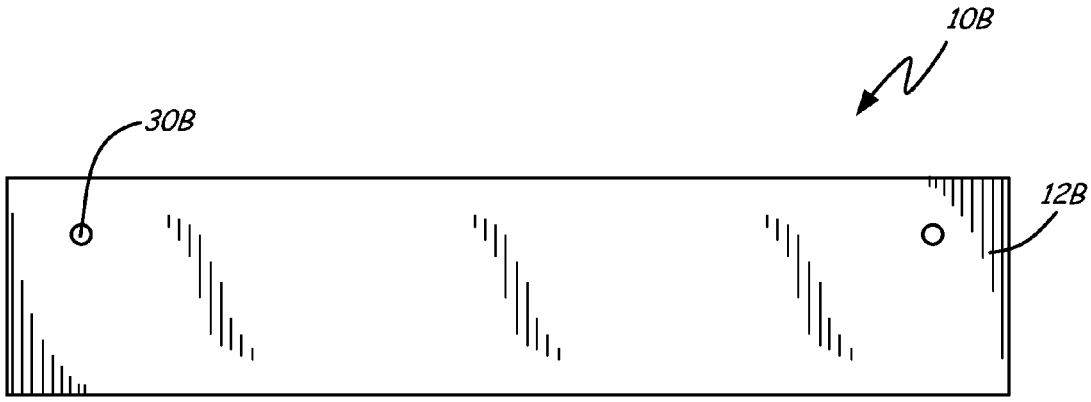
FIG. 14 is a rear elevational view of the second embodiment from FIGS. 9-13.
Figure 15:
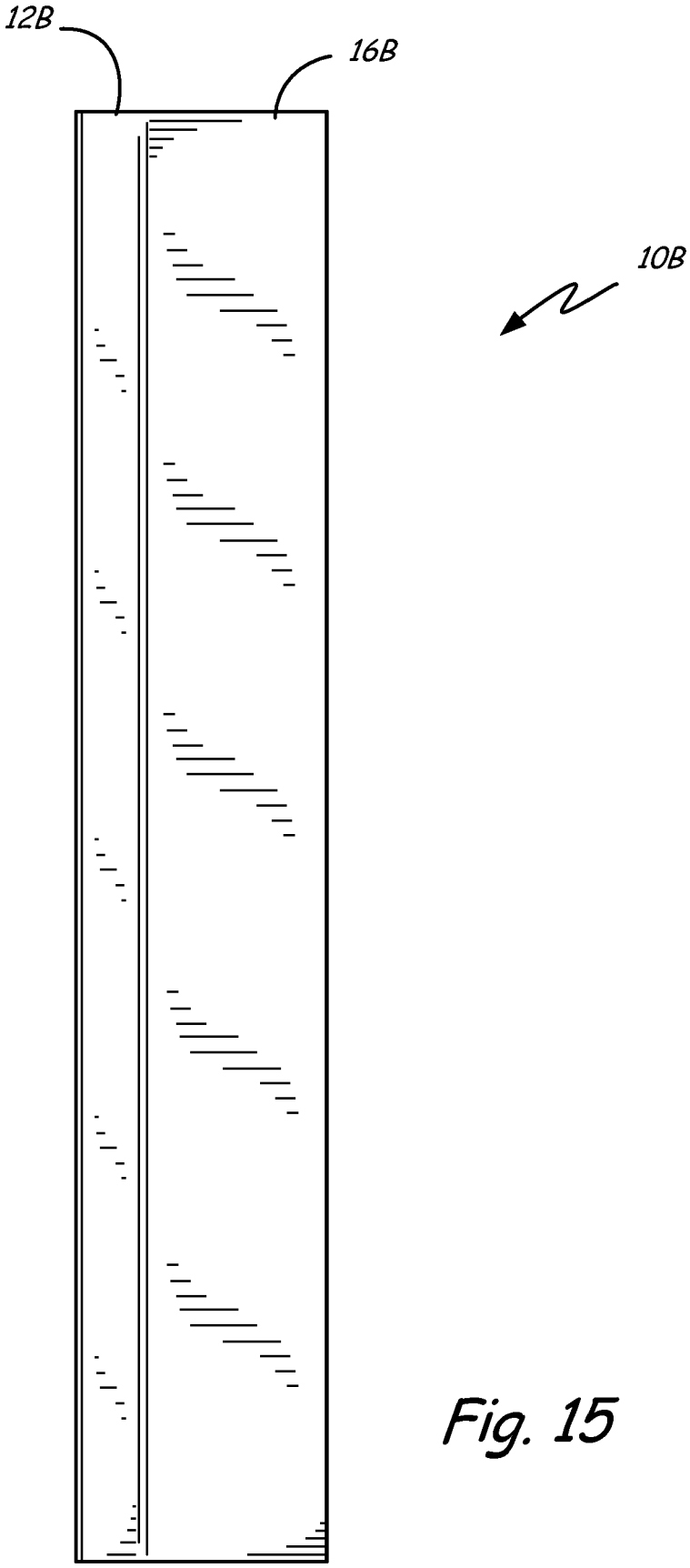
FIG. 15 is a bottom plan view of the second embodiment from FIGS. 9-14.

FIG. 9 is a perspective view, FIG. 10 is a top plan view, FIG. 11 is a right side view, FIG. 12 is a front elevational view, FIG. 13 is a left side view, FIG. 14 is a rear elevational view, and FIG. 15 is a bottom plan view of a second embodiment of mounting apparatus 10B for displaying pictures and flat art objects in accordance with the present invention. Mounting apparatus 10B is similar to mounting apparatus 10A described above and therefore, the same reference numerals are used to denote like parts. Mounting apparatus 10B includes backbone 12B, spacer 14B, and ledge 16B. Ledge 16B further includes top portion 22B, bottom potion 24B, and ridges 26B. Mounting apparatus 10B can be manufactured by molding, machining, or extruding, of metals, wood, or other materials.

For the sake of brevity, the differences between embodiments will be highlighted. A backside of backbone 12B is flat because backbone 12B has screw or nail holes 30B positioned about 16 inches (40.64 cm) apart instead of mounting trough 18A. Backbone 12B has an overall length of about 1.20 inches (3.05 cm). Spacer 14B is significantly shorter than spacer 14A in mounting apparatus 10A. Spacer 14B can be continued vertically upwards and rounded become integral with backbone 12B. A length of top portion 22B is similar to a length of bottom portion 24B. Ridges 26B can include a thin, rubberized shelf material to provide friction and help to prevent the picture from sliding forward, although testing has shown that with an angle of 6 degrees or more is adequate to keep the picture secure from sliding forward unless a low friction surface is used. Ridges 26B can also be machined in to the part as an alternative to the shelving material. A far edge of bottom portion 24B (opposite attachment to top portion 22B) is about 0.92 inches (2.35 cm) away from the wall. For use, backbone 12B of mounting apparatus 10B is nailed or otherwise attached to a wall or other support. A bottom of a picture rests on bottom portion 24B of ledge 16B and leans backwardly over spacer 14B and over a top of backbone 12B to rest against the wall.

Figure 16:
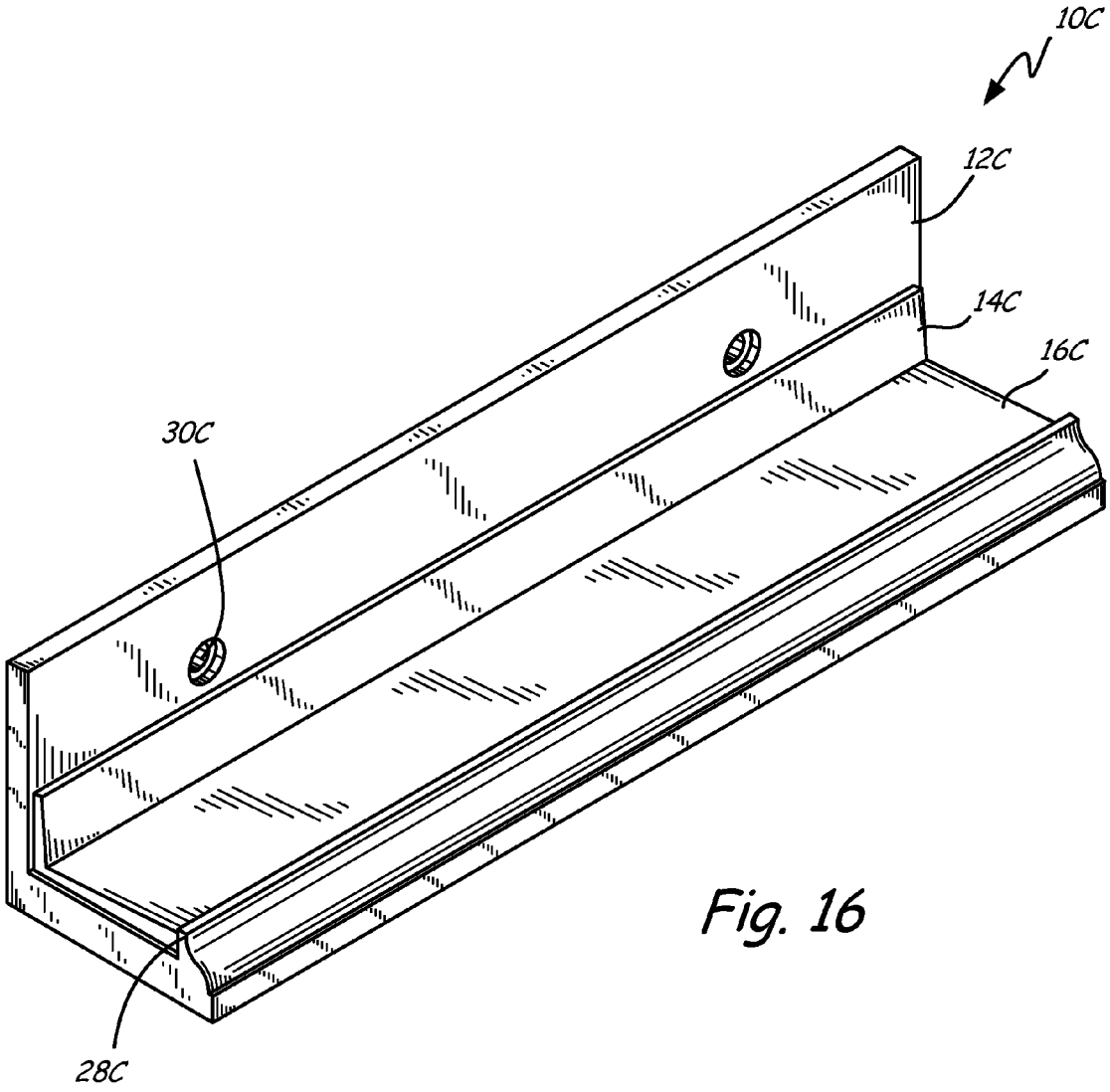
FIG. 16 is a perspective view of a third embodiment of an apparatus for displaying pictures and flat art objects in accordance with the present invention.
Figure 17:
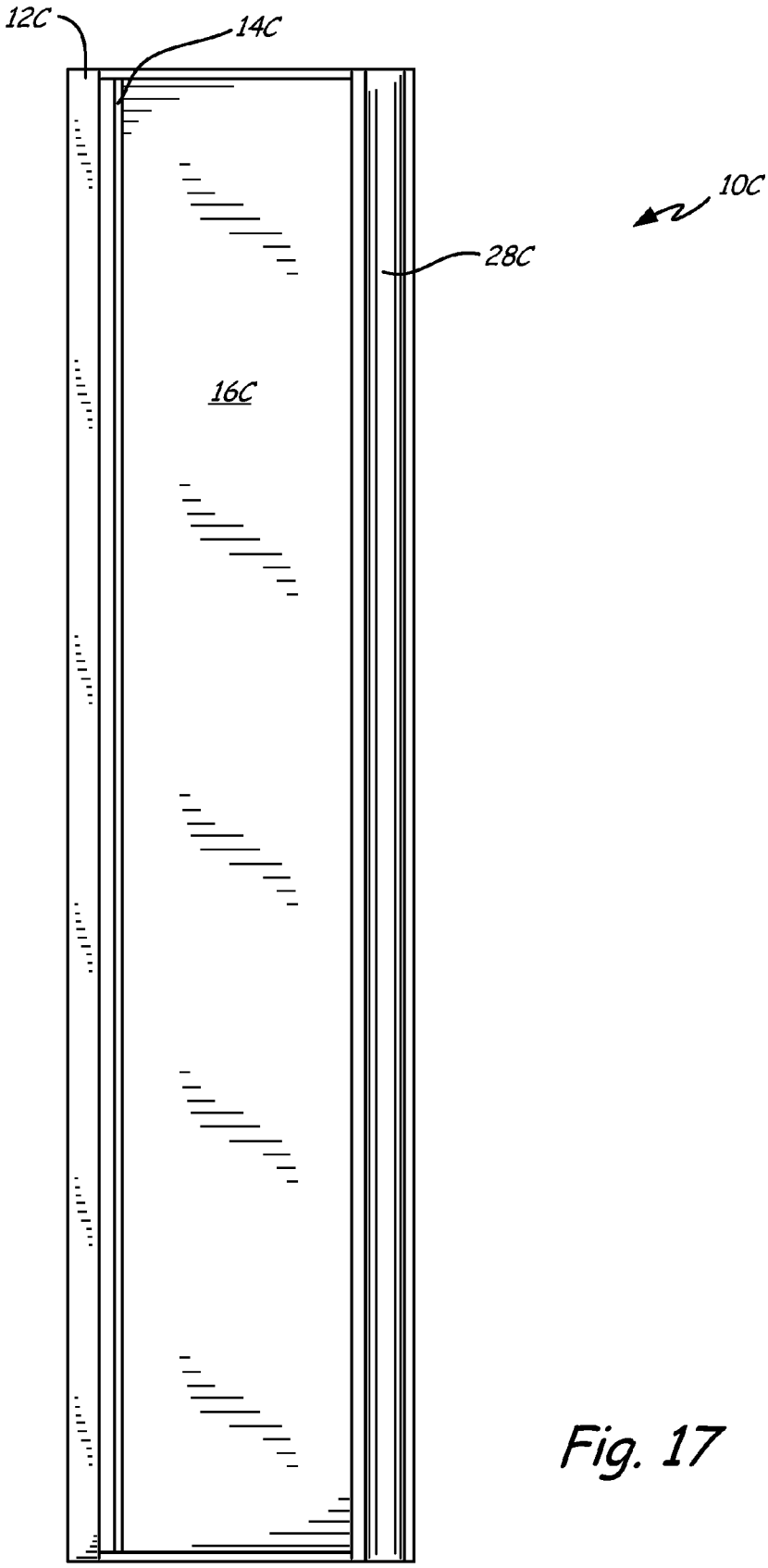
FIG. 17 is a top plan view of the third embodiment from FIG. 16.
Figure 18:
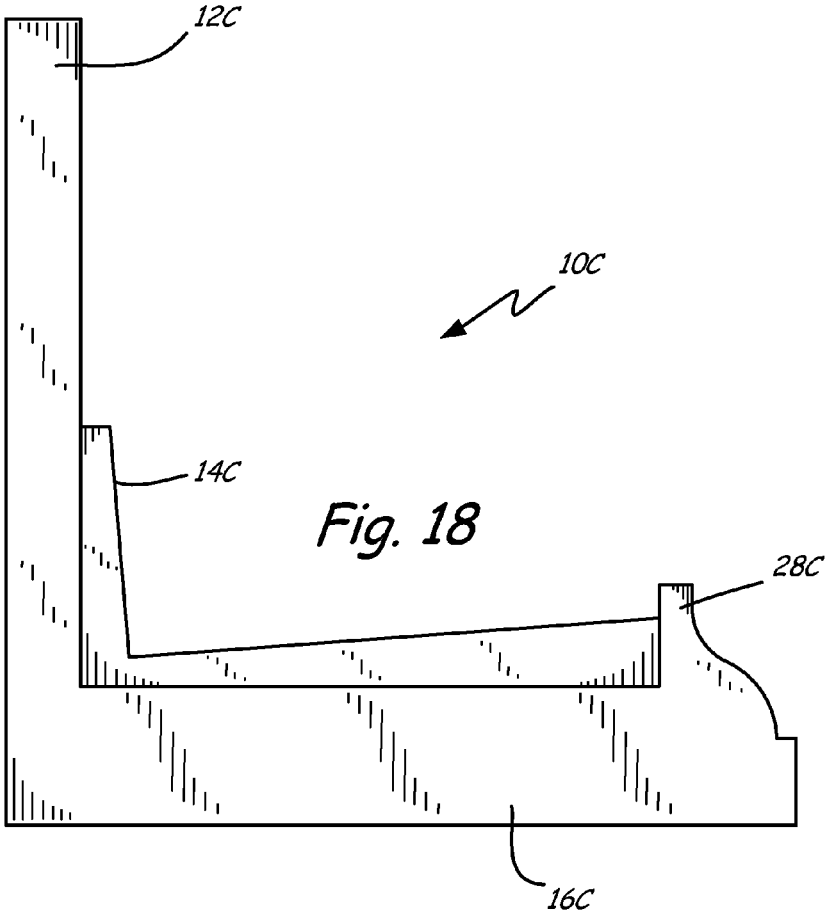
FIG. 18 a right side view of the third embodiment from FIGS. 16-17.
Figure 19:
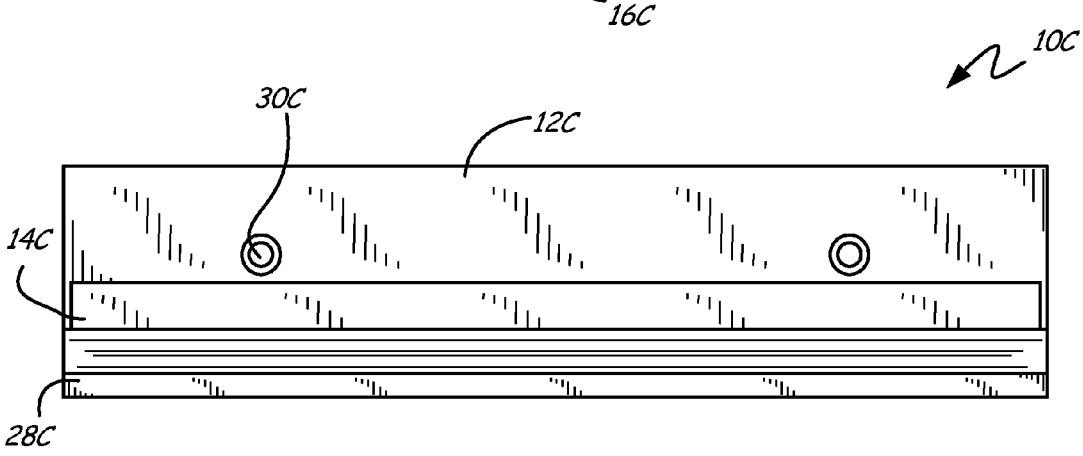
FIG. 19 is a front elevational view of the third embodiment from FIGS. 16-18.
Figure 20:
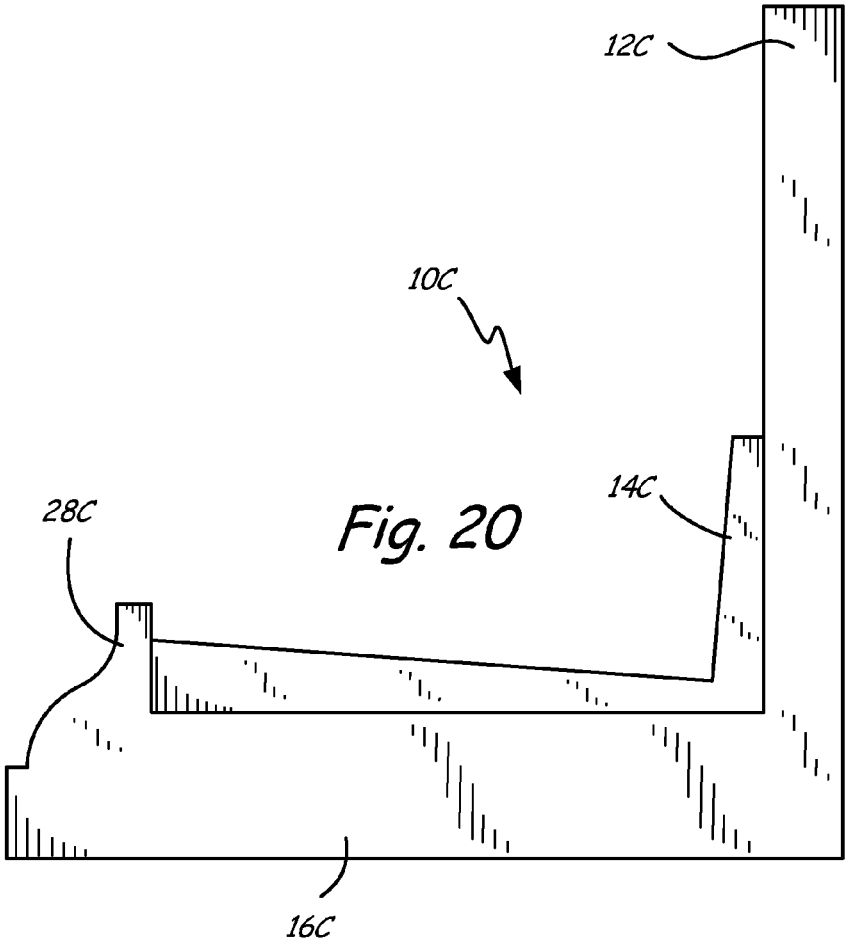
FIG. 20 is a left side view of the third embodiment from FIGS. 16-19.
Figure 21:
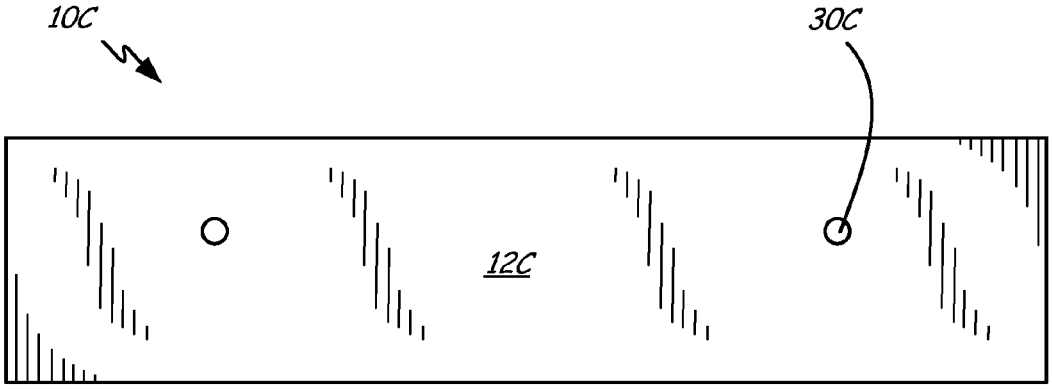
FIG. 21 is a rear elevational view of the third embodiment from FIGS. 16-20.
Figure 22:
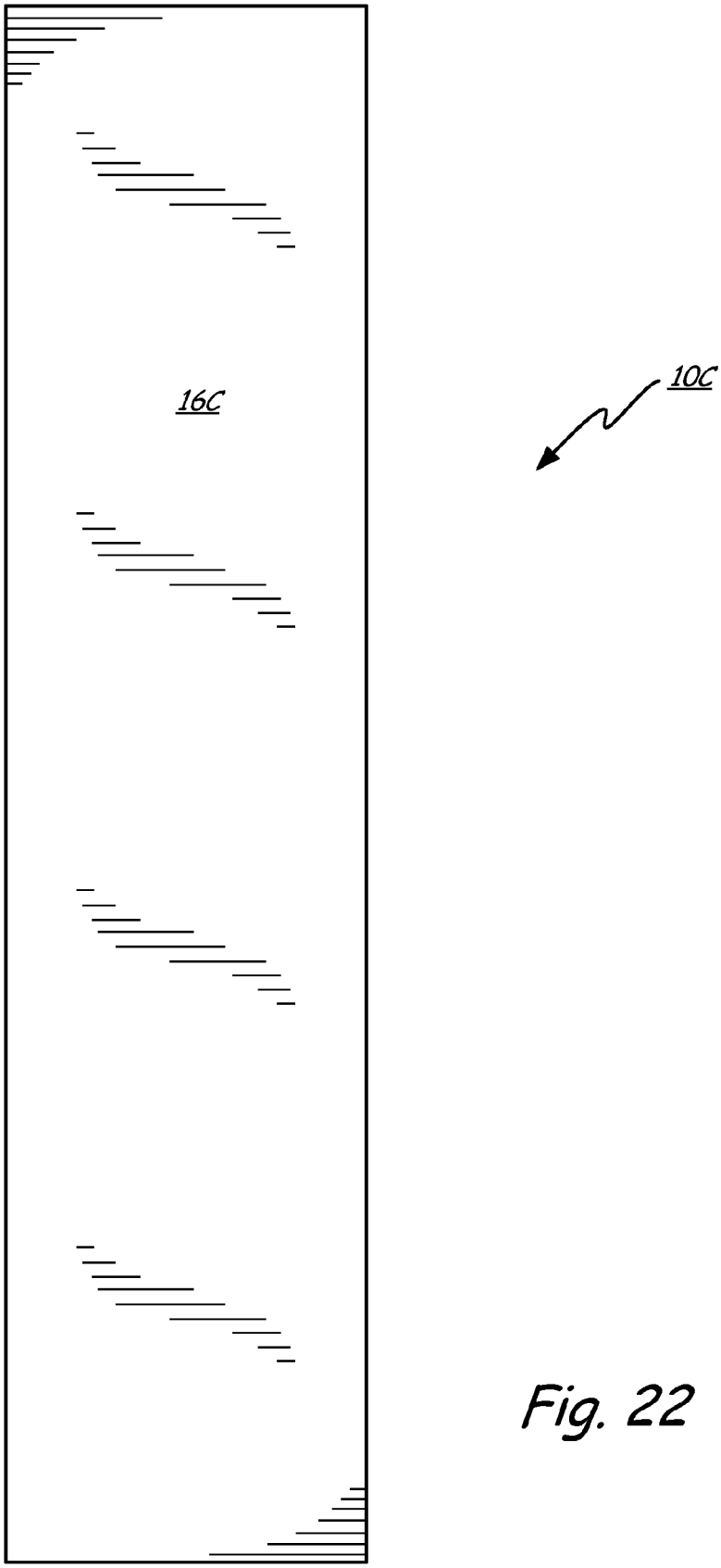
FIG. 22 is a bottom plan view of the third embodiment from FIGS. 16-21.

FIG. 16 is a perspective view, FIG. 17 is a top plan view, FIG. 18 is a right side view, FIG. 19 is a front elevational view, FIG. 20 is a left side view, FIG. 21 is a rear elevational view, and FIG. 22 is a bottom plan view of a third embodiment of mounting apparatus 10C for displaying pictures and flat art objects in accordance with the present invention. Mounting apparatus 10C is similar to mounting apparatuses 10A and 10B described above and therefore, the same reference numerals are used to denote like parts. Mounting apparatus 10C includes backbone 12C, spacer 14C, and ledge 16C. Ledge 16C further includes retaining lip 28C. Mounting apparatus 10C can be manufactured by molding, machining, or extruding, of metals, wood, or other materials.

For the sake of brevity, the differences between embodiments will be highlighted. Like mounting apparatus 10B, mounting apparatus 10C includes two mounting holes 30C. Backbone 12C and ledge 16C are attached to one another at a right angle (90 degrees). Spacer 14C is an L-shaped inlay adjacent the right angle of backbone 12 and ledge 16C and can be custom fitted to obtain a proper picture angle. Spacer 14C is shown as inserted and fastened into the right angle, but it could also be incorporated such that mounting apparatus 10C is one solid piece. For use, backbone 12C of mounting apparatus 10C is nailed or otherwise attached to a wall or other support. A bottom of a picture rests on ledge 16C and leans backwardly over spacer 14C and over a top of backbone 12C to rest against the wall.

Figure 23:
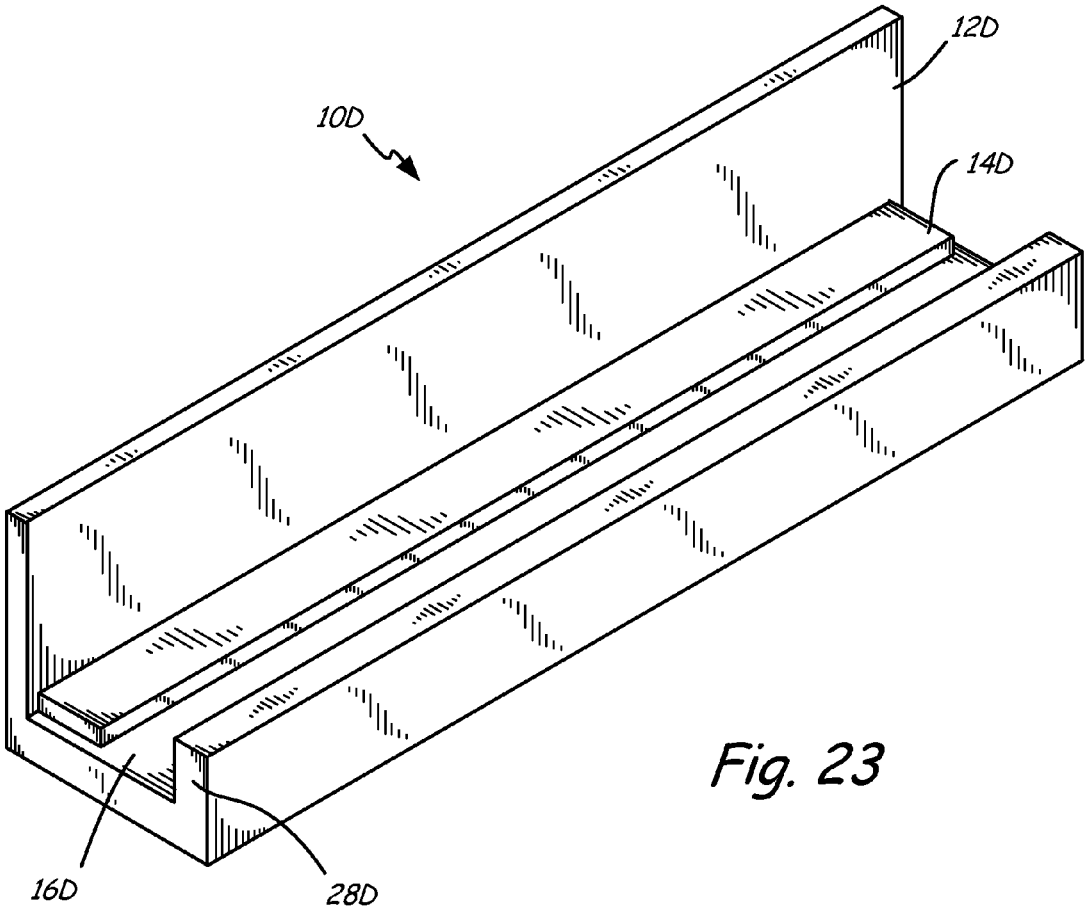
FIG. 23 is a perspective view of a fourth embodiment of an apparatus for displaying pictures and flat art objects in accordance with the present invention.
Figure 24:
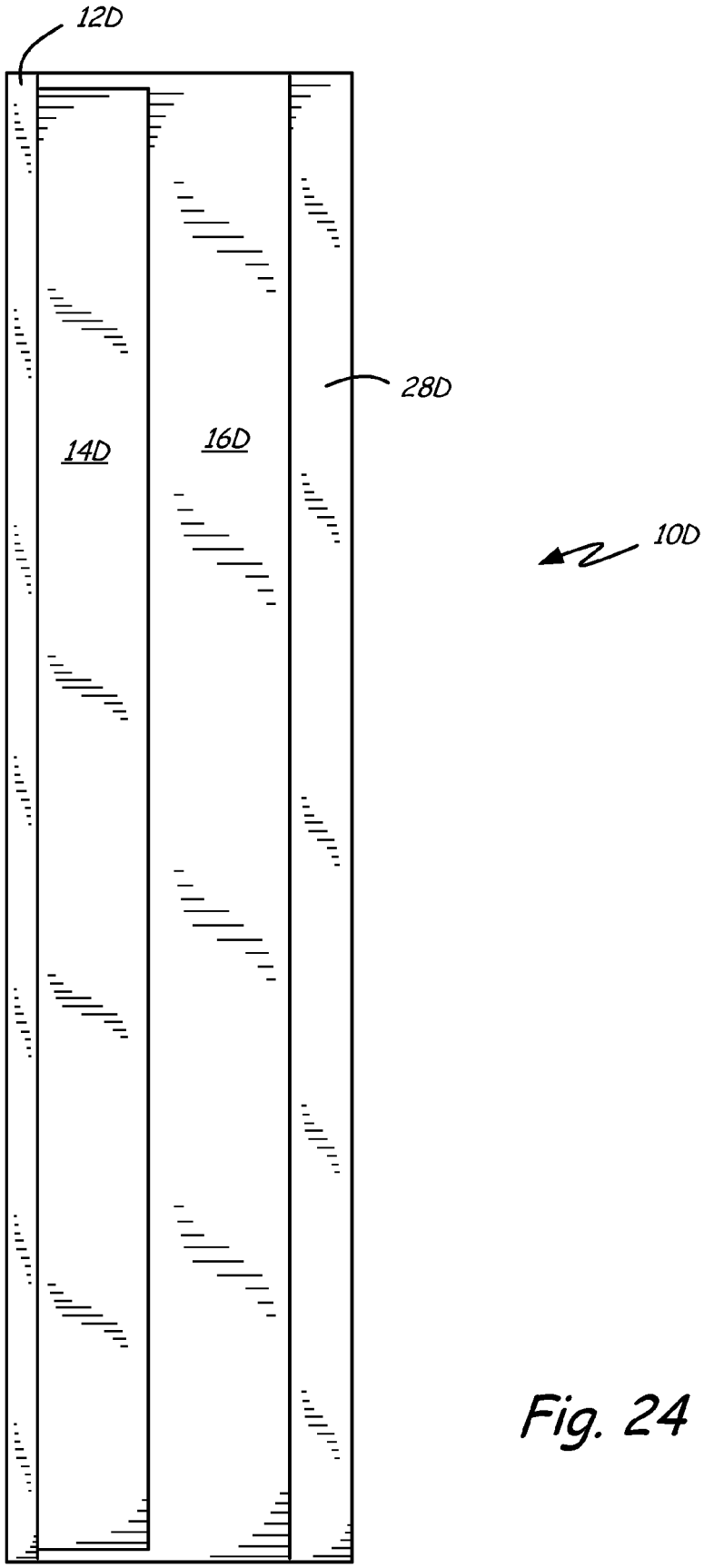
FIG. 24 is a top plan view of the fourth embodiment from FIG. 23.
Figure 25:
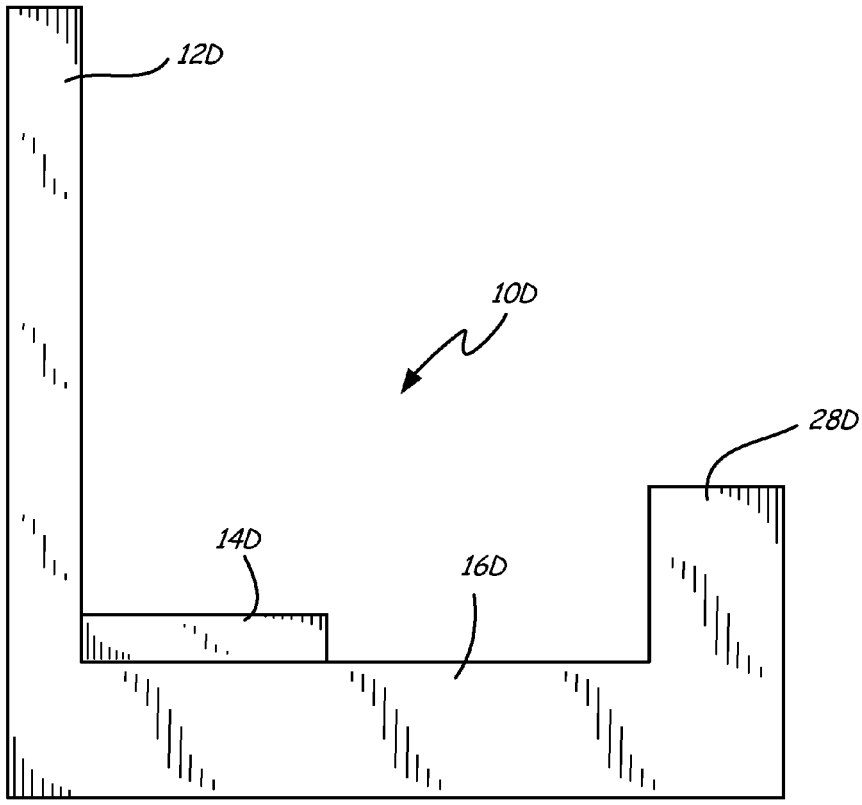
FIG. 25 a right side view of the fourth embodiment from FIGS. 23-24.
Figure 26:
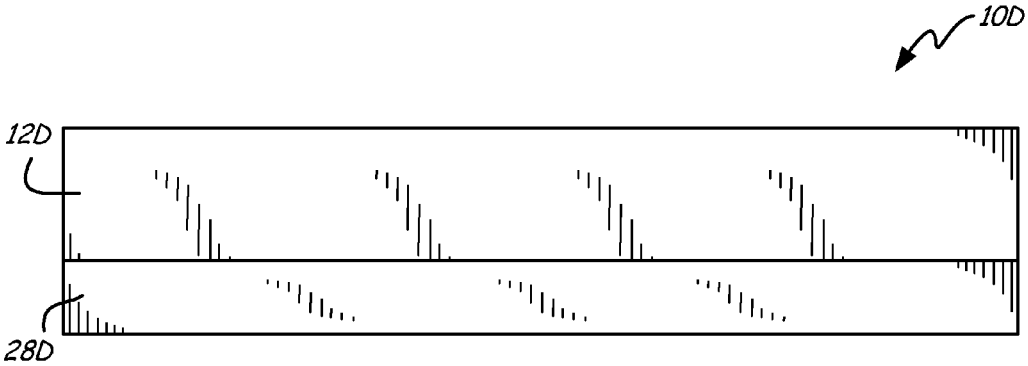
FIG. 26 is a front elevational view of the fourth embodiment from FIGS. 23-25.
Figure 27:
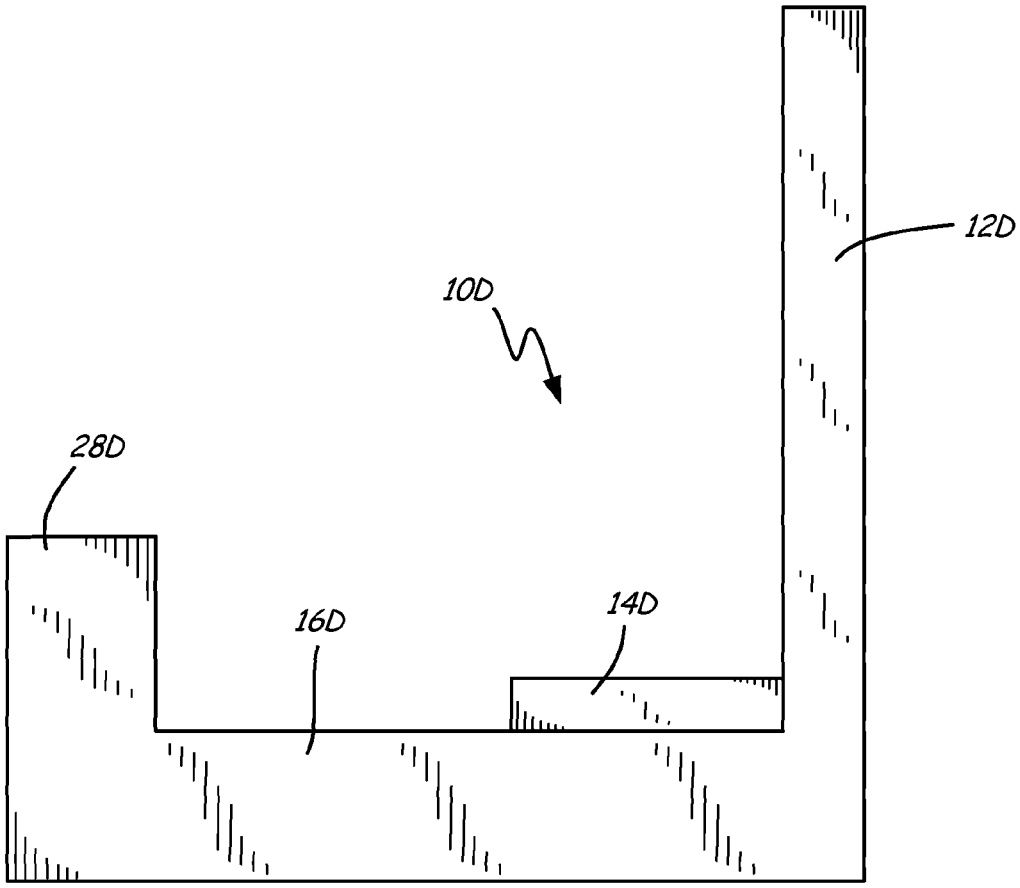
FIG. 27 is a left side view of the fourth embodiment from FIGS. 23-26.
Figure 28:
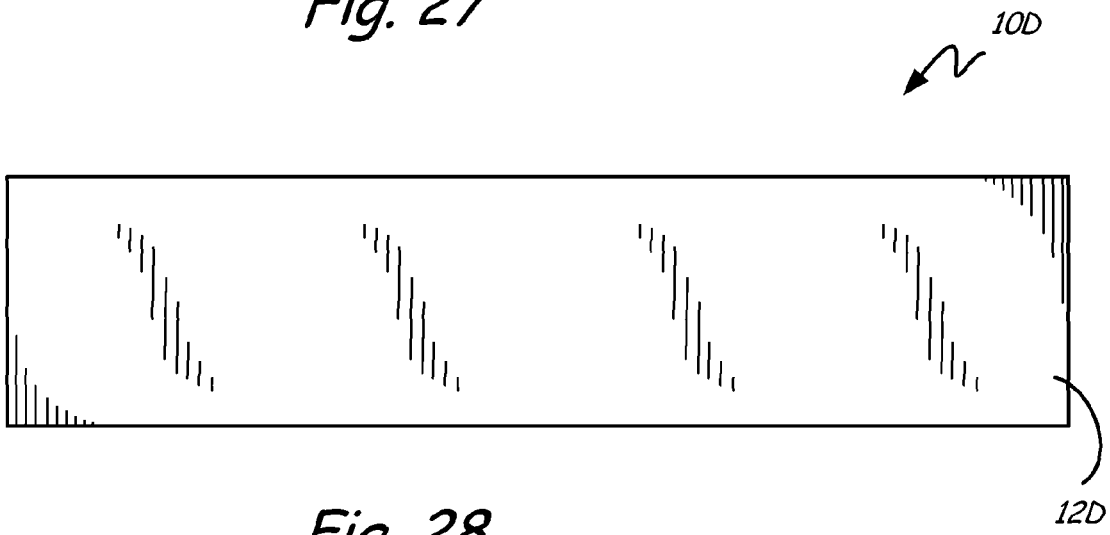
FIG. 28 is a rear elevational view of the fourth embodiment from FIGS. 23-27.
Figure 29:
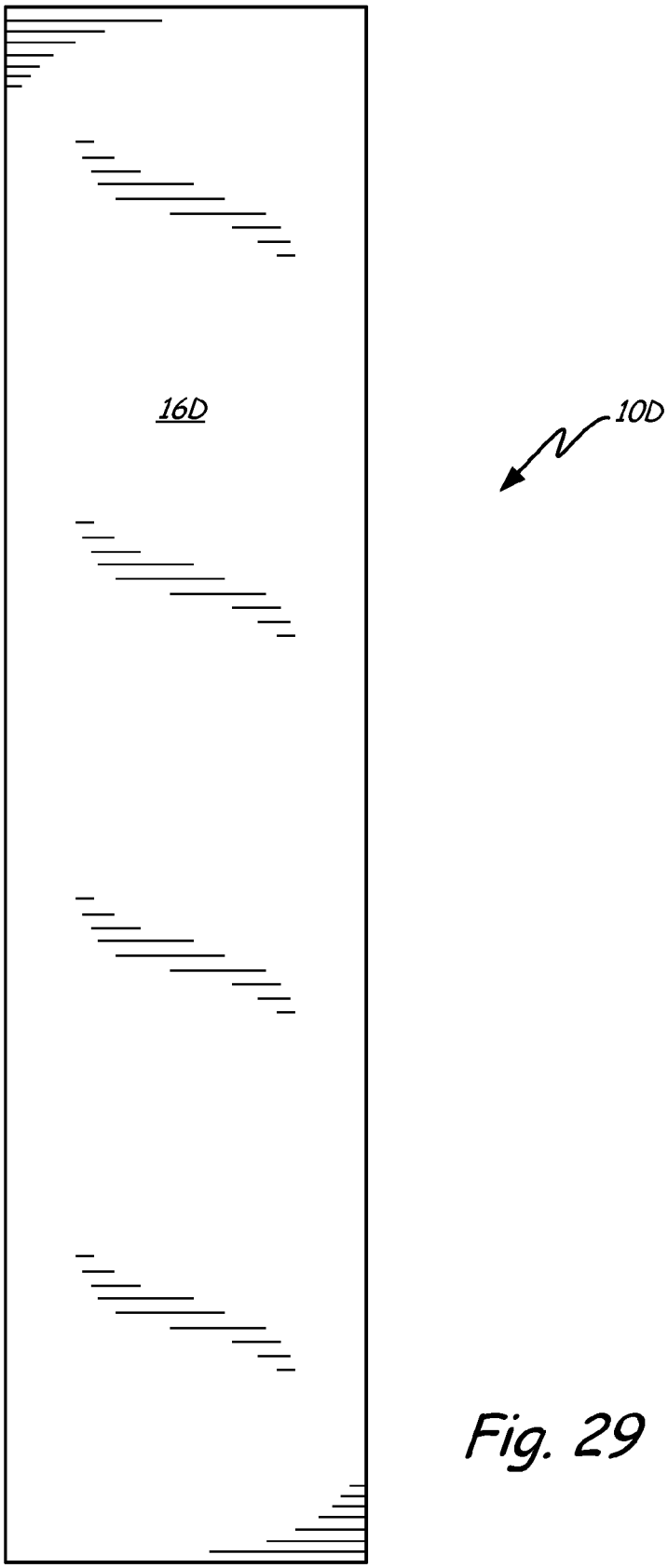
FIG. 29 is a bottom plan view of the fourth embodiment from FIGS. 23-28.

FIG. 23 is a perspective view, FIG. 24 is a top plan view, FIG. 25 is a right side view, FIG. 26 is a front elevational view, FIG. 27 is a left side view, FIG. 28 is a rear elevational view, and FIG. 29 is a bottom plan view of a fourth embodiment of mounting apparatus 10D for displaying pictures and flat art objects in accordance with the present invention. Mounting apparatus 10D is similar to mounting apparatuses 10A-10C described above and therefore, the same reference numerals are used to denote like parts. Mounting apparatus 10D includes backbone 12D, spacer 14D, and ledge 16D. Ledge 16D further includes retaining lip 28D. Mounting apparatus 10D can be manufactured by molding, machining, or extruding, of metals, wood, or other materials.

For the sake of brevity, the differences between embodiments will be highlighted. Like mounting apparatus 10C, backbone 12D and ledge 16D are attached to one another a right angle (90 degrees). Spacer 14D is rectangular and lies along ledge 16D adjacent the right angle of backbone 12D and ledge 16D. Spacer 14D is shown as inserted and fastened into the right angle, but it could also be incorporated such that mounting apparatus 10D is one solid piece. For use, backbone 12D of mounting apparatus 10D is nailed or otherwise attached to a wall or other support. A bottom of a picture rests on ledge 16D and leans backwardly over spacer 14D and over a top of backbone 12D to rest against the wall. Spacer 14D pushes a bottom of the picture forward to interface with retaining lip 28B and lean backwards toward the wall. The width the ledge 16D needs to be somewhat wide (1" or greater) in order to provide enough slope of the picture to keep it secure from vibrations that can occur in a room when doors slam or other disturbances that can cause vibration. This variation can be made into a commercial object by making the outside of the front rail decorated with painting, staining, having some machining for patterns on the outer surface. The width of spacer 14D is selected to provide the off-set of the picture base from the wall and also sets the angle of the part so that the top of the picture intersects with the wall at an appropriate distance.

Figure 30:
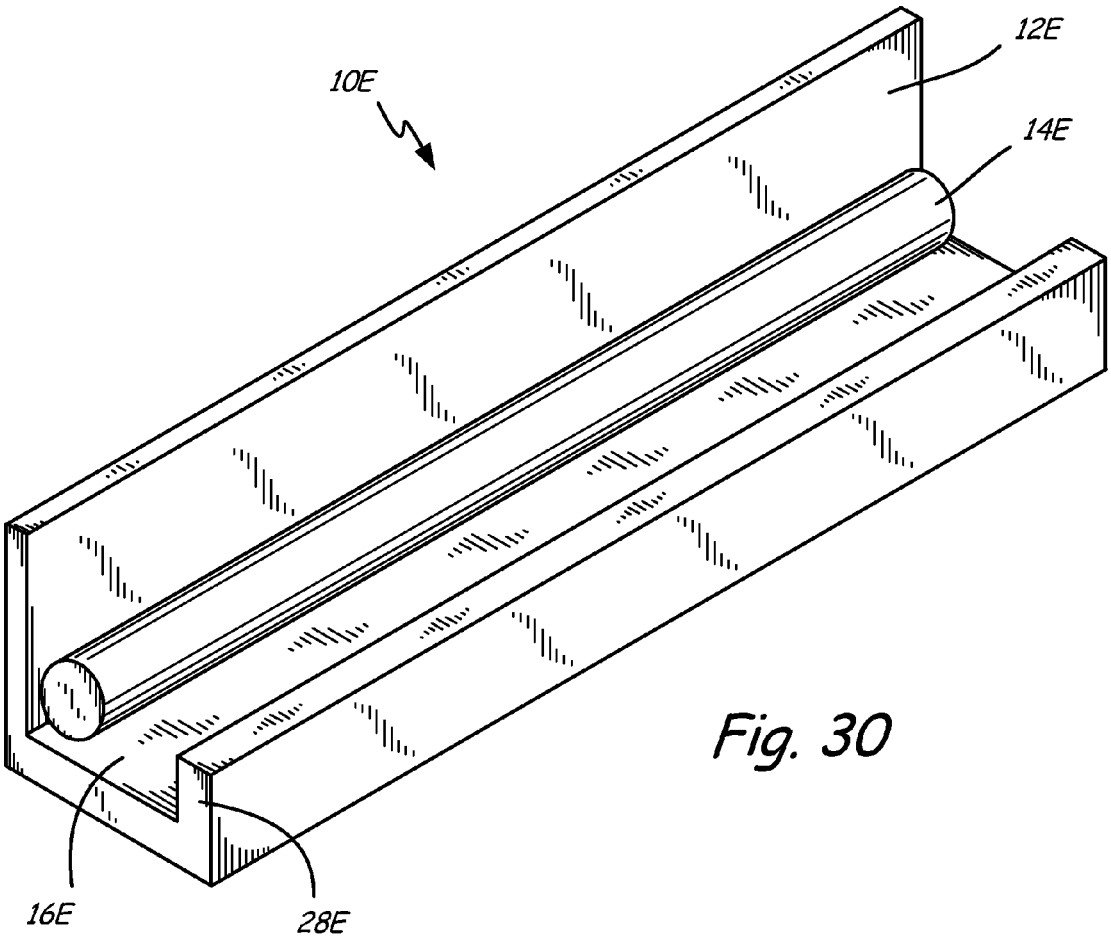
FIG. 30 is a perspective view of a fifth embodiment of an apparatus for displaying pictures and flat art objects in accordance with the present invention.
Figure 31:
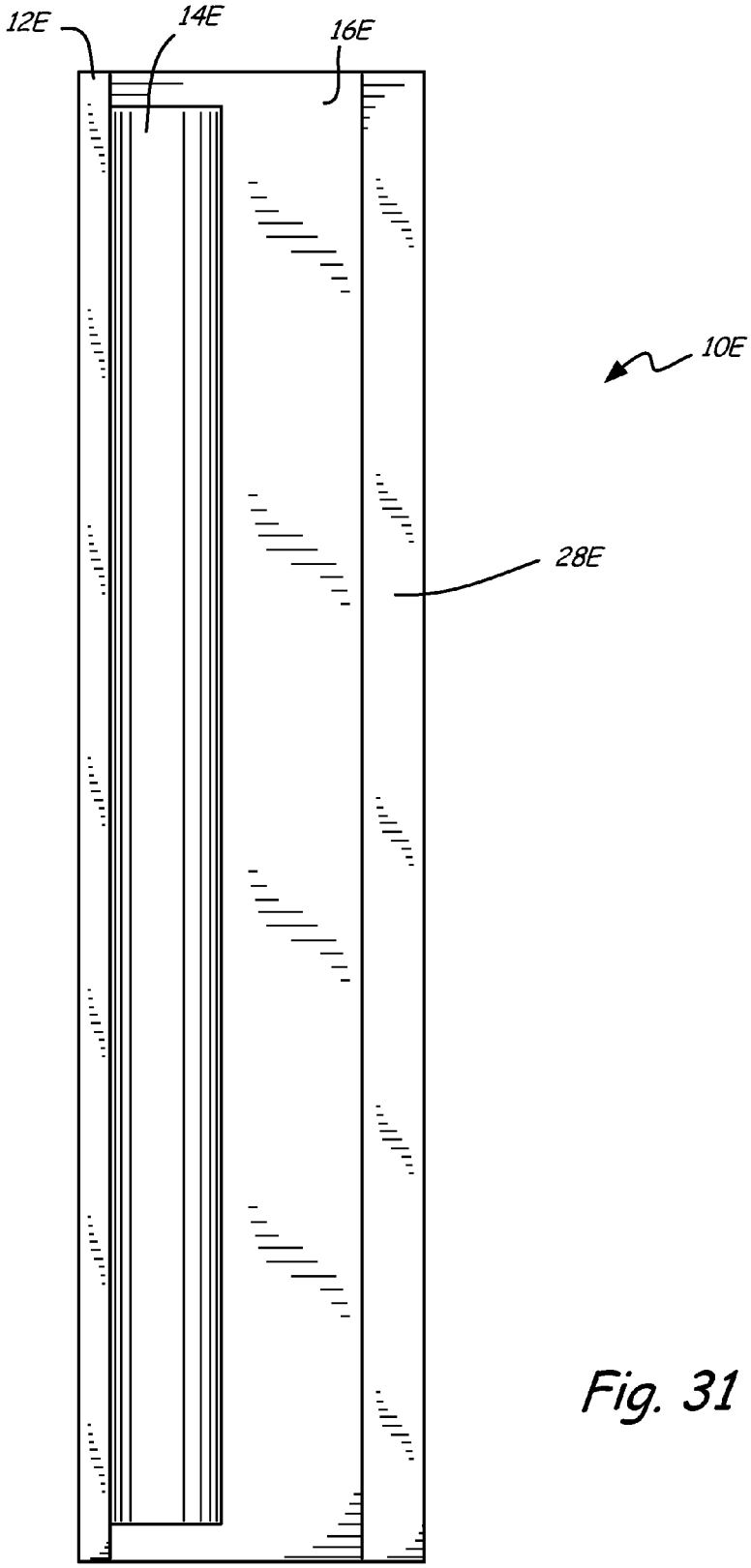
FIG. 31 is a top plan view of the fifth embodiment from FIG. 30.
Figure 32:
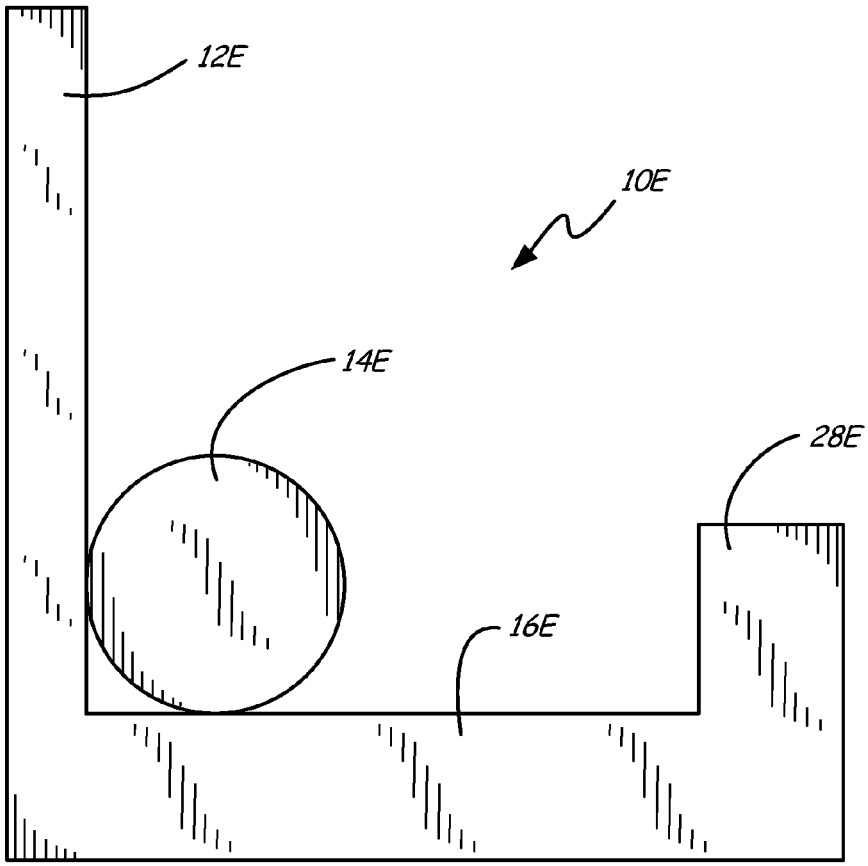
FIG. 32 a right side view of the fifth embodiment from FIGS. 30-31.
Figure 33:
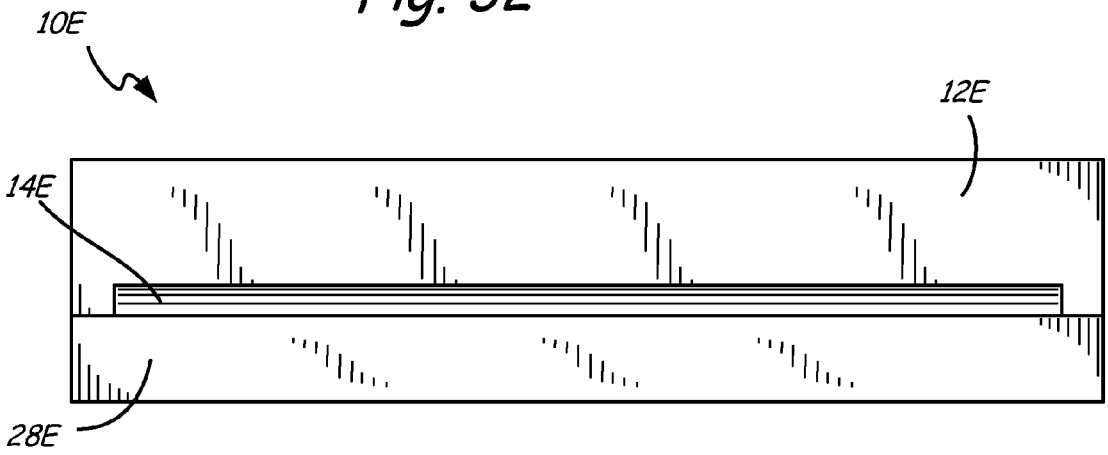
FIG. 33 is a front elevational view of the fifth embodiment from FIGS. 30-32.
Figure 34:
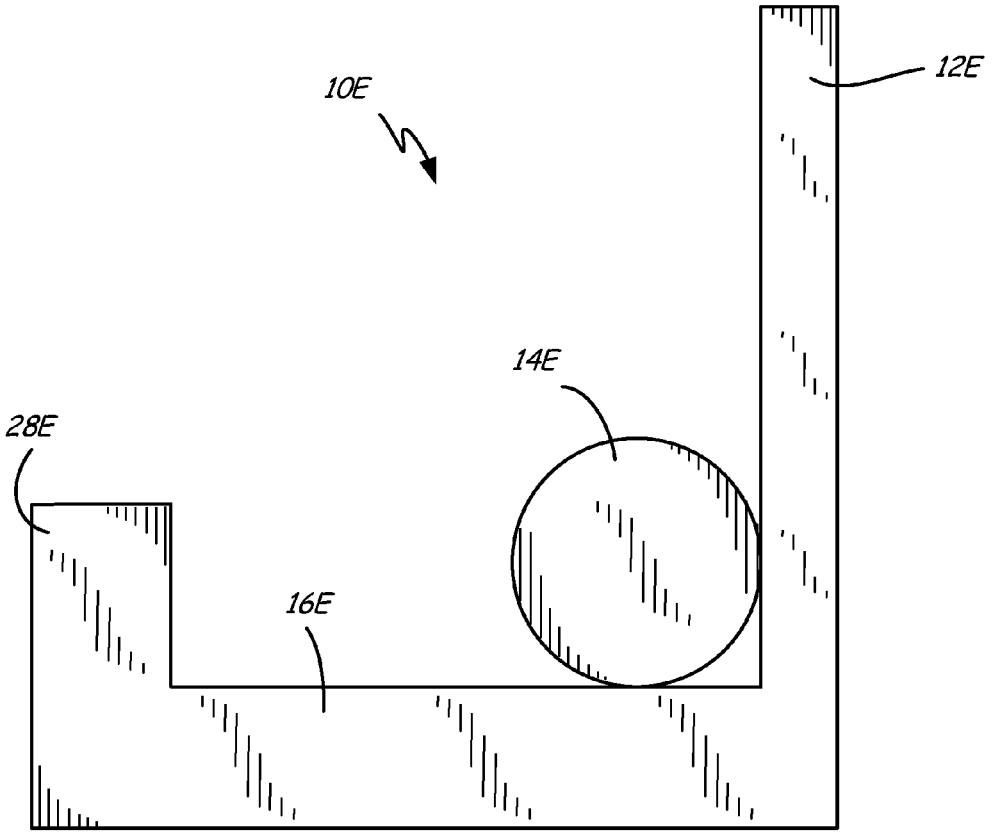
FIG. 34 is a left side view of the fifth embodiment from FIGS. 30-33.
Figure 35:
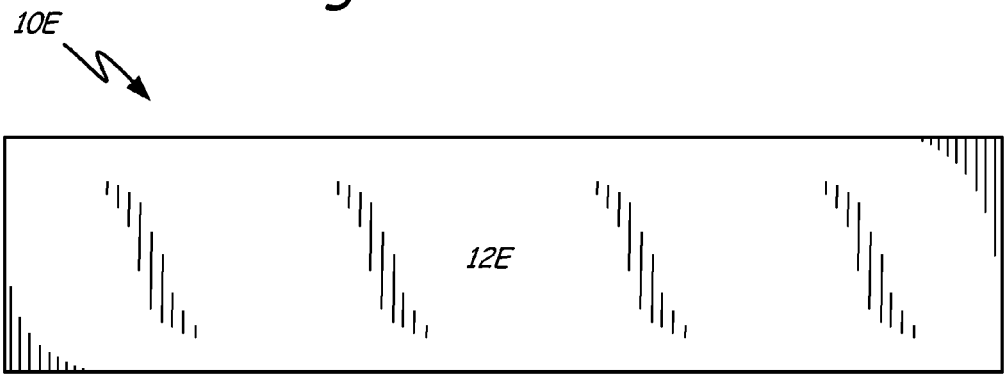
FIG. 35 is a rear elevational view of the fifth embodiment from FIGS. 30-34.
Figure 36:
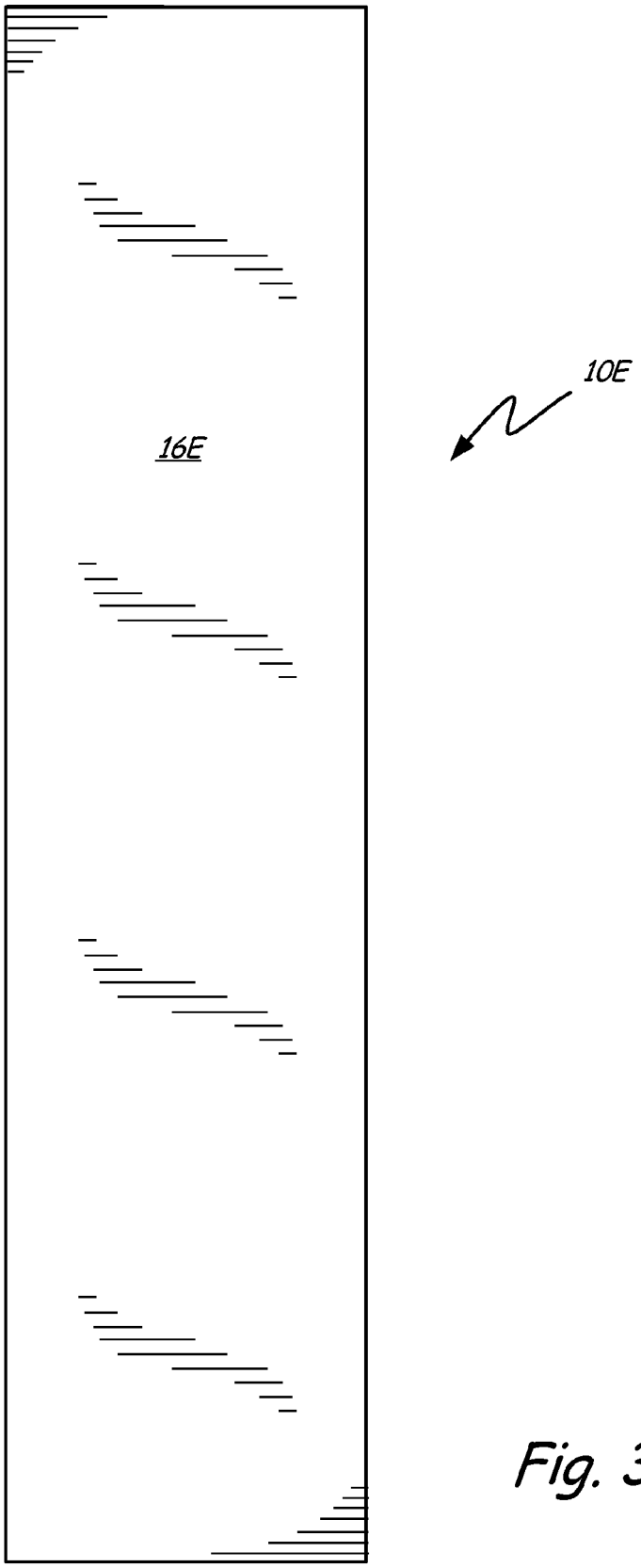
FIG. 36 is a bottom plan view of the fourth embodiment from FIGS. 30-35.

FIG. 30 is a perspective view, FIG. 31 is a top plan view, FIG. 32 a right side view, FIG. 33 is a front elevational view, FIG. 34 is a left side view, FIG. 35 is a rear elevational view, and FIG. 36 is a bottom plan view of a fifth embodiment of mounting apparatus 10E for displaying pictures and flat art objects in accordance with the present invention. Mounting apparatus 10E is similar to mounting apparatuses 10A-10D described above and therefore, the same reference numerals are used to denote like parts. Mounting apparatus 10E includes backbone 12E, spacer 14E, and ledge 16E. Ledge 16E further includes retaining lip 28E. Mounting apparatus 10E can be manufactured by molding, machining, or extruding, of metals, wood, or other materials.

For the sake of brevity, the differences between embodiments will be highlighted. Like mounting apparatus 10C and mounting apparatus 10D, backbone 12E and ledge 16E are attached to one another at a right angle (90 degrees). Spacer 14E is cylindrical rod and lies along ledge 16E adjacent the right angle of backbone 12E and ledge 16E. Spacer 14E is shown as inserted and fastened into the right angle, but it could also be incorporated such that mounting apparatus 10E is one solid piece. For use, backbone 12E of mounting apparatus 10E is nailed or otherwise attached to a wall or other support. A bottom of a picture rests on ledge 16E and leans backwardly over spacer 14E and over a top of backbone 12E to rest against the wall.

Retaining lip 28E can be taller with the advantage of greater security to prevent the picture from sliding forward, but also blocks the view of the lower part of the picture, the frame, or whatever the lower part of the art object would be. Retaining lip 28E can be shorter with the advantage of minimal blockage of the bottom part of the picture, but may not be tall enough to block thicker pictures (frames) from potential sliding forward. A piece of thin metal can be fastened to the ledge 16E and allows for insertion of various retaining lips 28E to adjust the height according to the picture being displayed. Further, dowels can be used to attach retaining lip 28E to ledge 16E.

The mounting of pictures has been simplified with the apparatus and methods in this simple, but innovative design. It has also been made more stable and allows for easy removal and replacement. Additionally, the use of multiple pictures with no limit on length of the display offer options to the user that have never been possible previously. The methods and apparatus described offer an affordable and easy to use solution to many of the problems confronted by the user in displaying their favorite artwork. Also, a person or company with many plaques or awards can easily and pleasantly display them. It also provides the option for easy take down of a bulletin board or white board for changing the daily special in a restaurant or leaving a message for mom or other family members.

The current embodiments have been tested to be immune to normal vibrations caused by slamming doors and wind currents from opened doors that allow wind to blow across mounted pictures and have been tested to a picture height of 30" and a weight of 50 pounds. Future embodiments will look at extending the size of pictures that can be displayed by changing the spacer width and the angles of the slanted ledge and the slanted connection to the spacer. By increasing the width of the spacer and adjusting these angles, much larger pictures can be mounted in this apparatus. Thickness may have to be adjusted to provide for greater strength to handle pictures that are significantly heavier than 50 pounds.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An apparatus for mounting an object with respect to a wall, the apparatus comprising:

a ledge for supporting the object, the ledge having a bottom portion extending forward from a rear end to a forward end for receiving the object and a top portion having a lower end attached to the rear end of the bottom portion at approximately right angle, wherein an upper surface of the bottom portion of the ledge has a plurality of parallel ridges that run parallel to the forward end of the ledge;

a substantially horizontal spacer for spacing the ledge at a distance from the wall, the spacer having a rear end and a forward end attached to the top portion of the ledge such that the object supported on the ledge leans rearwardly over the spacer toward the wall, wherein the attachment between the top portion of the ledge and the forward end of the spacer forms an obtuse angle so that the top portion of the ledge extends downward and forward from the forward end of the spacer, and the bottom portion of the ledge extends forward and is inclined upward from its rear end to its forward end, and wherein a distance from the rear end of the spacer to the forward end of the spacer is greater than a distance from the forward end of the spacer to the forward end of the ledge;

a substantially vertical backbone for attaching to the wall, the backbone having a bottom portion attached at an approximately right angle to the rear end of the spacer and a top portion for attaching to the wall such that the object supported on the ledge rests against the wall above the top portion of the backbone, wherein a height of the vertical backbone is greater than a height of the top portion of the ledge;

a mounting trough attached at an approximately right angle to the top portion of the backbone and extending rearwardly toward the wall, the mounting trough including a horizontal T-shaped slot having an opening, wherein the opening to the T-shaped slot has a height that is approximately half of a height of the mounting trough; and a support extending rearwardly from the bottom portion of the backbone parallel the mounting trough and abutting the wall.

2. The apparatus of claim 1, wherein the ledge, spacer, and backbone are formed by an integral metal extrusion and have substantially equal thicknesses.

3. The apparatus of claim 1, wherein the bottom portion of the ledge is slanted between 1 and 5 degrees.

4. The apparatus of claim 1, wherein the backbone has a length of about 1.01 inches.

5. The apparatus of claim 1, wherein the spacer has a length of about 0.92 inches.

6. The apparatus of claim 1, wherein the T-shaped slot has a height of about 0.40 inches, a width of about 0.24 inches, and an opening of about 0.22 inches.

7. The apparatus of claim 1, wherein the support is about 0.17 inches long.

8. An apparatus for mounting an object with respect to a wall, the apparatus comprising:

an L-shaped ledge for supporting the object, the ledge having a bottom portion for receiving the object and a top portion attached to a rear end of the bottom portion at approximately right angle, wherein the bottom portion of the ledge is slanted upwardly from horizontal so that a forward end of the ledge is higher than the rear end of the ledge, and wherein an upper surface of the bottom portion of the ledge has a plurality of parallel ridges that run parallel to the forward end of the ledge;

a substantially horizontal spacer for spacing the ledge at a distance from the wall, the spacer having a rear end and a forward end attached to the top portion of the ledge and forming an obtuse angle so that the ledge is located downward and forward of the spacer and a distance from the rear end of the spacer to the front end of the spacer is greater than a distance from the front end of the spacer to the front end of the ledge, such that the object supported on the ledge leans rearwardly over the spacer toward the wall; and a substantially vertical backbone for attaching to the wall, the backbone having a bottom portion attached at an approximately right angle to the rear end of the spacer and a top portion for attaching to the wall such that the object supported on the ledge rests against the wall above the top portion of the backbone, wherein the backbone has a height that is greater than a height of the top portion of the ledge;

a mounting trough attached at an approximately right angle to the top portion of the backbone and extending rearwardly toward the wall, wherein the mounting trough includes a horizontal T-shaped slot; and a support extending rearwardly from the bottom portion of the backbone, the support extending parallel to the mounting trough and abutting the wall so that when both the support and the trough contact an outer surface of the wall and the backbone is parallel to the outer surface of the wall.

* * * * *